US012326010B2

(12) United States Patent
Hetzner

(10) Patent No.: US 12,326,010 B2
(45) Date of Patent: Jun. 10, 2025

(54) ADJUSTABLE POOL CLEANING TOOL

(71) Applicant: Jess L. Hetzner, Temecula, CA (US)

(72) Inventor: Jess L. Hetzner, Temecula, CA (US)

( * ) Notice: Subject to any disclaimer, the term of this patent is extended or adjusted under 35 U.S.C. 154(b) by 281 days.

(21) Appl. No.: 18/045,955

(22) Filed: Oct. 12, 2022

(65) Prior Publication Data

US 2023/0113080 A1 Apr. 13, 2023

Related U.S. Application Data

(60) Provisional application No. 63/262,467, filed on Oct. 13, 2021.

(51) Int. Cl.
*E04H 4/16* (2006.01)
*A46B 9/02* (2006.01)

(52) U.S. Cl.
CPC ..... *E04H 4/1609* (2013.01); *A46B 9/028* (2013.01); *A46B 2200/30* (2013.01); *E04H 4/1636* (2013.01)

(58) Field of Classification Search
CPC ..... E04H 4/16; A46B 9/02; A46B 5/0095
See application file for complete search history.

(56) References Cited

U.S. PATENT DOCUMENTS 1,478,213 A 12/1923 Forisdal
1,906,902 A 5/1933 Firestone et al.
1,983,923 A 12/1934 Stevens et al.
2,090,412 A 8/1937 Geiger
2,472,572 A 6/1949 Dailey
2,561,025 A 7/1951 Le Febvre
3,004,362 A 10/1961 Day
3,085,267 A 4/1963 Jacuzzi
3,134,129 A 5/1964 Allen
3,206,783 A 9/1965 Schwartz
3,377,641 A 4/1968 McGregor
4,247,216 A 1/1981 Pansini
4,407,038 A 10/1983 Haase
4,446,646 A 5/1984 Van't Veld
4,466,152 A 8/1984 Moss et al.
4,499,626 A 2/1985 Schneider
4,606,091 A 8/1986 Sartori
4,619,065 A 10/1986 Jones
(Continued)

OTHER PUBLICATIONS

Purity Pool Leaf Rakes Catalog, 2 pg.

*Primary Examiner* — Michael D Jennings
(74) *Attorney, Agent, or Firm* — KNOBBE, MARTENS, OLSON & BEAR, LLP

(57) ABSTRACT

A pool cleaning tool includes a brush head having an elongate frame and bristles extending therefrom; a first repositionable member attached to a first end of the elongate frame; and a second repositionable member attached to a second end of the elongate frame, wherein each of the first repositionable member and the second repositionable member includes: a forward end pivotally coupled to the elongate frame about a rotation axis; an upper surface configured to be rotatable about the rotation axis, the upper surface configured to force the bristles against a surface being cleaned as a result of the brush head being pushed through water in a direction perpendicular to a direction at which the bristles extend; and a locking mechanism configured to selectively retain the upper surface in each of a plurality of positions with respect to elongate frame.

20 Claims, 26 Drawing Sheets

(56) References Cited

U.S. PATENT DOCUMENTS

| | | | | |
|---|---|---|---|---|
| 4,637,087 | A | 1/1987 | Feinberg | |
| 4,870,773 | A | 10/1989 | Schmucker et al. | |
| 5,161,278 | A | 11/1992 | Tomm | |
| 5,333,334 | A | 8/1994 | Frieb | |
| 5,414,889 | A * | 5/1995 | Sartori | B25G 3/38 15/171 |
| 5,471,699 | A | 12/1995 | Shaw | |
| 5,473,786 | A | 12/1995 | Resh | |
| 5,487,397 | A | 1/1996 | Bean | |
| 5,551,115 | A | 9/1996 | Newville | |
| 5,568,668 | A | 10/1996 | Margolin | |
| 5,890,254 | A | 4/1999 | Courtney et al. | |
| 6,134,739 | A | 10/2000 | Gonzalez | |
| 6,199,241 | B1 | 3/2001 | Anumah | |
| 6,227,744 | B1 | 5/2001 | Fodrocy et al. | |
| 6,302,277 | B1 | 10/2001 | Resh | |
| 6,349,444 | B1 | 2/2002 | Sander | |
| 6,368,502 | B1 | 4/2002 | Resh | |
| 6,408,560 | B1 | 6/2002 | Bloom | |
| 6,594,850 | B2 | 7/2003 | Libman et al. | |
| 6,872,026 | B2 | 3/2005 | Petner | |
| 7,124,533 | B2 | 10/2006 | Kleckner | |
| 7,269,921 | B2 | 9/2007 | Lee | |
| 7,395,629 | B1 | 7/2008 | Thomas | |
| 7,721,380 | B2 | 5/2010 | Libman et al. | |
| 7,730,571 | B2 * | 6/2010 | Libman | A46B 7/04 15/145 |
| 7,891,132 | B2 | 2/2011 | Hetzner | |
| 8,398,330 | B2 | 3/2013 | Bensussan et al. | |
| 10,188,200 | B1 * | 1/2019 | Hetzner | A46B 9/10 |
| 2004/0255427 | A1 | 12/2004 | Gavney, Jr. | |
| 2006/0218738 | A1 | 10/2006 | Brugora | |

* cited by examiner

ADJUSTABLE POOL CLEANING TOOL

CROSS-REFERENCE TO RELATED APPLICATIONS

This application claims the benefit of U.S. Provisional Application No. 63/262,467, titled ADJUSTABLE POOL CLEANING TOOL, filed on Oct. 13, 2021, which is hereby incorporated by reference herein in its entirety.

BACKGROUND

Field

This disclosure relates generally to pool equipment, and more specifically to pool cleaning brushes.

Description

Pool cleaning brushes typically include a brush head attached to a distal end of an elongate pole and a handle positioned at a proximal end of the pole. The handle can be manipulated by a user in order to cause the brush head to pass along a pool wall and/or floor in order to clean the pool. Typical pool brushes can be inefficient and tiring to use, however. As such, there is a need for improved pool brushes designed to be more effective and less tiring to use.

SUMMARY

The disclosure herein presents cleaning tools for use in cleaning the walls and floor of a swimming pool, the cleaning tools including one or more adjustable bristle pressure generation mechanisms. For example, some embodiments comprise two adjustable bristle pressure generation mechanisms, with one positioned at either end of a brush head frame member. Each of the adjustable bristle pressure generation mechanisms can comprise a rotatable member that is shaped to generate a force that forces the bristles of a brush against a surface being cleaned as the brush is passed through the water. The rotatable member can be configured to be retained or locked in a plurality of orientations relative to the brush head frame, with each orientation corresponding to a different magnitude of force generated on the bristles.

According to some embodiments, a pool cleaning tool comprises: a brush head comprising an elongate frame and bristles extending therefrom, the elongate frame extending from a first end to a second end, and the elongate frame having an upper surface and a lower surface, the bristles extending from the lower surface; a first corner brush removably attached to the first end of the elongate frame; and a second corner brush removably attached to the second end of the elongate frame, wherein each of the first corner brush and the second corner brush comprises: a body having additional bristles extending therefrom; a cavity for receiving one of the first end or the second end of the elongate frame; and an adjustable pressure generation member for forcing the bristles of the brush head against a surface being cleaned, wherein the adjustable pressure generation member comprises: a forward end pivotally coupled to the body such that the adjustable pressure generation member can pivot with respect to the body about a pivot axis; a locking member configured to selectively retain the adjustable pressure generation member in each of a plurality of positions with respect to the body; and a pressure generation surface positioned above the upper surface of the elongate frame, wherein each of the plurality of positions of the adjustable pressure generation member with respect to the body corresponds to a different orientation of the pressure generation surface with respect to the body.

In some embodiments, the locking member comprises a protrusion configured to selectively mate with each of a plurality of recesses in the body. In some embodiments, the plurality of recesses in the body are aligned along an arc shaped path. In some embodiments, the arc shaped path comprises a center of rotation that is aligned with the pivot axis. In some embodiments, the pressure generation surface comprises an s-shaped profile. In some embodiments, the pressure generation surface is angled inward toward a center of the brush head.

According to some embodiments, a pool cleaning tool comprises: a brush head comprising an elongate frame and bristles extending therefrom, the elongate frame extending from a first end to a second end, and the elongate frame having an upper surface and a lower surface, the bristles extending from the lower surface; a first repositionable member attached to the first end of the elongate frame; and a second repositionable member attached to the second end of the elongate frame, wherein each of the first repositionable member and the second repositionable member comprises: a forward end pivotally coupled to the elongate frame about a rotation axis; an upper surface configured to be rotatable about the rotation axis, the upper surface configured to force the bristles against a surface being cleaned as a result of the brush head being pushed through water in a direction perpendicular to a direction at which the bristles extend; and a locking mechanism configured to selectively retain the upper surface in each of a plurality of positions with respect to elongate frame.

In some embodiments, the first repositionable member and the second repositionable member are each attached directly to the elongate frame. In some embodiments, the first repositionable member and the second repositionable member are each attached to the elongate frame through a separate body that is attached to the elongate frame. In some embodiments, the separate body is part of a removable corner brush. In some embodiments, the upper surface comprises an s-shaped profile. In some embodiments, the locking mechanism comprises at least one protrusion configured to selectively engage each of a plurality of mating recesses.

According to some embodiments, a removable corner brush for a pool cleaning tool comprises: a body extending along a longitudinal direction from a first end to a second end; a plurality of bristles extending from the second end of the body; a cavity for receiving an elongate member of a pool cleaning tool, the cavity comprising an opening through the first end of the body, the cavity extending within the body along the longitudinal direction; and a repositionable member, the repositionable member comprising: a forward end pivotally coupled to the body such that the repositionable member can pivot with respect to the body about a pivot axis; a locking mechanism configured to selectively retain the repositionable member in each of a plurality of positions with respect to the body; and an upper surface extending at an angle to the longitudinal direction, wherein each of the plurality of positions of the repositionable member with respect to the body corresponds to a different orientation about the pivot axis of the upper surface with respect to the body.

In some embodiments, the pivot axis extends along the longitudinal direction. In some embodiments, the locking mechanism comprises at least one protrusion configured to selectively engage each of a plurality of mating recesses. In some embodiments, the at least one protrusion is located at a distal end of an elongate curved member of the repositionable member, and wherein the plurality of mating recesses are part of the body. In some embodiments, the plurality of mating recesses are aligned along an arc shaped path. In some embodiments, the arc shaped path comprises a center of rotation that is aligned with the pivot axis. In some embodiments, the upper surface comprises an s-shaped profile. In some embodiments, the upper surface comprises a curved profile.

For purposes of this summary, certain aspects, advantages, and novel features of the inventions are described herein. It is to be understood that not necessarily all such advantages may be achieved in accordance with any particular embodiment of the inventions. Thus, for example, those skilled in the art will recognize that the inventions may be embodied or carried out in a manner that achieves one advantage or group of advantages as taught herein without necessarily achieving other advantages as may be taught or suggested herein.

BRIEF DESCRIPTION OF THE DRAWINGS

The foregoing and other features, aspects, and advantages of the present disclosure are described in detail below with reference to the drawings of various embodiments, which are intended to illustrate and not to limit the disclosure. The features of some embodiments of the present disclosure, which are believed to be novel, will be more fully disclosed in the following detailed description. The following detailed description may best be understood by reference to the accompanying drawings wherein the same numbers in different drawings represents the same parts. All drawings are schematic and are not intended to show any dimension to scale. The drawings comprise the following figures in which:

FIGS. 4A-4I illustrate various views of a rotatable member of an adjustable pressure mechanism of the removable corner brush of FIG. 3A.

DETAILED DESCRIPTION

Figure 1A:
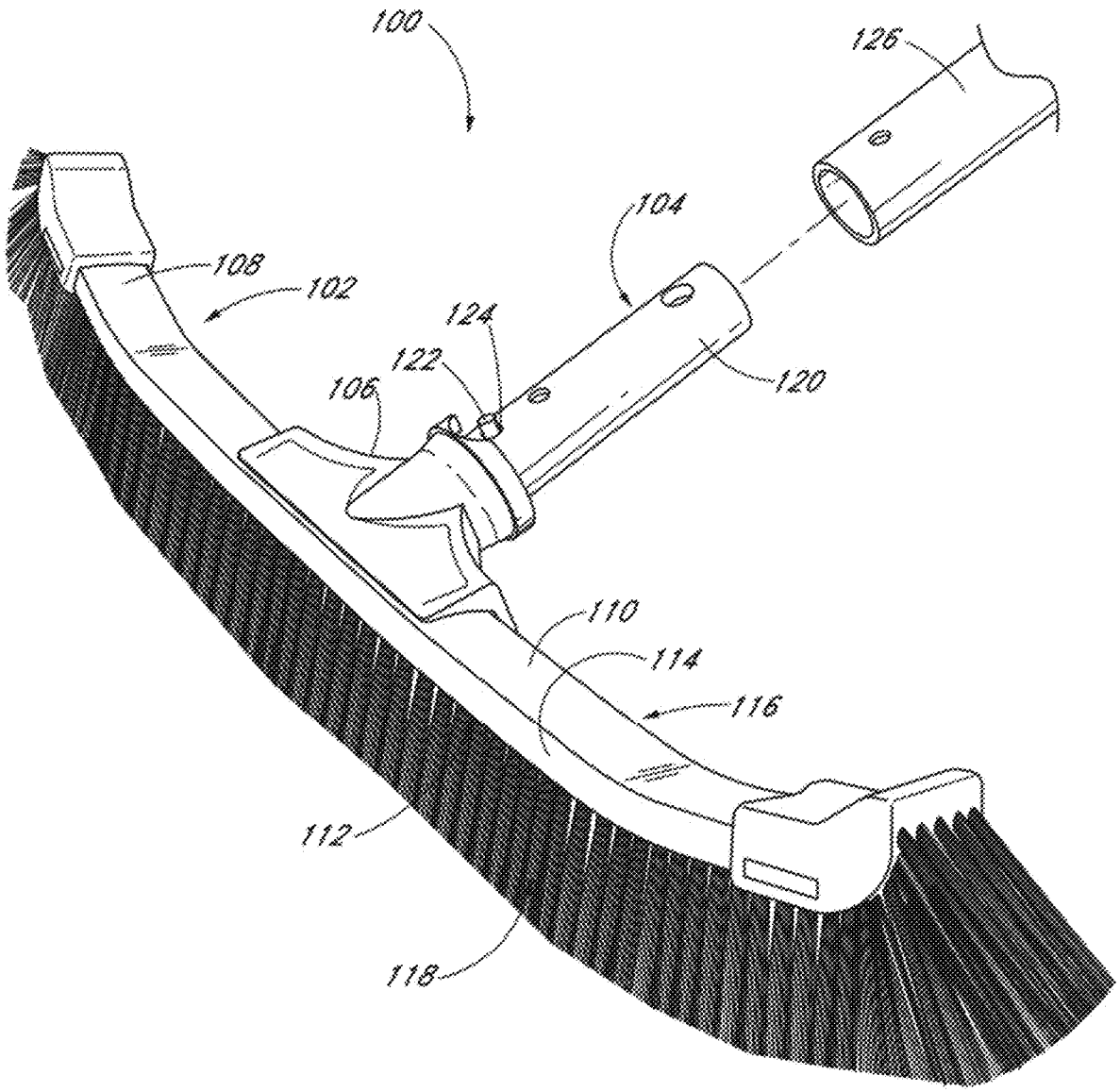
FIGS. 1A, 1B, and 1C illustrate perspective views of one embodiment of a cleaning tool.

Although several embodiments, examples, and illustrations are disclosed below, it will be understood by those of ordinary skill in the art that the inventions described herein extend beyond the specifically disclosed embodiments, examples, and illustrations and include other uses of the inventions and obvious modifications and equivalents thereof. Embodiments of the inventions are described with reference to the accompanying figures, wherein like numerals refer to like elements throughout. These drawings are considered to be a part of the entire description of some embodiments of the inventions. The terminology used in the description presented herein is not intended to be interpreted in any limited or restrictive manner simply because it is being used in conjunction with a detailed description of certain specific embodiments of the inventions. In addition, embodiments of the inventions can comprise several novel features and no single feature is solely responsible for its desirable attributes or is essential to practicing the inventions herein described.

The present disclosure provides various embodiments of cleaning tools, such as for use in cleaning swimming pools, which include a number of benefits. For example, some embodiments comprise one or more adjustable pressure generation mechanisms that are configured to force the bristles of a pool cleaning brush against the surface being cleaned, such as a swimming pool wall or floor, as the pool cleaning brush is passed through the water. The one or more adjustable pressure generation mechanisms may comprise, for example, a movable and/or rotatable member that is shaped and/or oriented such that passing the brush through water in a direction generally perpendicular to the bristles of the brush will cause water to flow over a surface of the movable member and force the brush head toward the surface being cleaned. In some embodiments, the movable or rotatable member may be referred to as a wing, foil, angled member, and/or the like.

Such a cleaning tool can be desirable for a number of reasons. For example, a pool cleaning brush head is typically attached to an elongate pole, such as a telescoping pole, with the brush head attached to a distal end of the pole, and the proximal end of the pole including a handle. When the cleaning brush is used to clean a pool surface, such as a wall or a floor, it can be awkward, difficult, and/or tiring to apply sufficient force to force the bristles of the brush against the surface being cleaned simply by manipulating the handle of the pole. This is because the person using the pool cleaning brush needs to apply forces to the brush head in multiple directions; namely, a first direction generally perpendicular to the direction of brush bristle extension (e.g., the direction that moves the brush head along the wall or floor of the pool), and a second direction generally parallel to the direction of brush bristle extension (e.g., to force the bristles against the wall or floor of the pool). By adding pressure generation mechanisms as disclosed herein to the brush head, simply moving the brush head through the water (e.g., applying force in the direction that moves the brush head along the wall or floor of the pool) will result in the water causing the pressure generation mechanisms to also force the bristles against the wall or floor. This can make the job less awkward, difficult, and/or tiring.

Needing to apply forces to the brush head in multiple directions applies both to when one is cleaning the wall of the pool and when one is cleaning the floor of the pool. Due to the different angles involved and that the person using the brush is typically standing in the same or similar position when cleaning the wall or floor, however, cleaning the vertical wall of a pool may be more awkward, difficult, and/or tiring than cleaning the floor of the pool. Further, various users may pass the brush through the water at different speeds, and some users pass the brush head along a vertical wall at a different speed than they pass the brush head along a horizontal floor. Accordingly, for each of these reasons, it can be desirable to have the pressure generation mechanisms be adjustable. By being adjustable, the amount of force generated by the water to force the bristles against the surface being cleaned can be variable for any particular speed of passing the brush head through the water.

In some embodiments, the one or more adjustable pressure generation mechanisms includes two adjustable pressure generation mechanisms, with one being positioned at each end of an elongate brush head frame. In some embodiments, the adjustable pressure generation mechanisms are incorporated into removable end caps or removable brushes that are removably attached to the ends of the brush head frame. In other embodiments, the adjustable pressure generation mechanisms may be incorporated into the brush head in a non-removable configuration.

In some embodiments, the one or more adjustable pressure generation mechanisms each comprises a rotatable member that is pivotally coupled to the brush head frame at a forward side (either directly or through another component, such as a removable brush body) such that a pitch or angle of the rotatable member is adjustable with respect to the brush head frame by pivoting the rotatable member about a pivot axis. Further, in some embodiments, a locking mechanism is included that is configured to lock or retain the rotatable member in one or more of a plurality of positions or orientations with respect to the brush head frame. In some embodiments, the position or orientation of the rotatable member is infinitely adjustable, while in some embodiments, the position or orientation of the rotatable member is configured to be locked or retained in one or more of a plurality of discrete positions with respect to the brush head frame.

In some embodiments, the locking mechanism includes one or more protrusions coupled to the rotatable member and configured to mate with a plurality of corresponding recesses in the brush head frame, in a body of a removable corner brush, and/or in another component coupled to the brush head frame. The plurality of corresponding recesses may be positioned or laid out along an arc shape that is centered on the pivot axis of the rotatable member. In other embodiments, various other locking mechanisms may be utilized, such as a friction lock, a ball detent mechanism, and/or the like. Further, although some embodiments include a pivot shaft or member at a forward end of the rotatable member and the locking mechanism at a rearward end of the rotatable member, some embodiments may reverse that positioning, may include the pivot axis and locking mechanism at a same end of the rotatable member, may position the pivot axis in a central region of the rotatable member, and/or the like.

Example Pool Cleaning Tool

FIG. 1A illustrates an embodiment of a cleaning tool 100 that can be used, for example, for cleaning the walls and floors of swimming pools. It will be appreciated, however, that the inventive features of various embodiments disclosed herein can have applications outside the pool cleaning and maintenance field. The following description describes various beneficial features of the cleaning tool 100. Any of these features may be included in other embodiments, such as the cleaning tool 200 described below with reference to FIGS. 2A-6E. Further, the cleaning tool 100 may be modified to incorporate any features of the cleaning tool 200, including, for example, the removable brushes 247 and/or the adjustable pressure mechanisms 261 illustrated in FIGS. 3A and 3B.

The cleaning tool 100 is adapted to couple with a standard elongate handle such as a telescopic pole used for various pool cleaning implements. As will be described in greater detail below, the cleaning tool 100 is designed to reduce breakage while substantially eliminating the need for a metal back reinforcement that is normally required for pool brush assemblies. The cleaning tool 100 is also designed with removable corner brushes having built-in magnets adapted to picking up magnetic debris such as hair pins while the brush is applied across a pool floor, which advantageously eliminates the need to use a separate tool for picking up such debris. In some embodiments, the cleaning tool 100 is considered to be a modular cleaning tool, since, for example, the cleaning tool can be used with or without the removable corner brushes.

As shown in FIG. 1A, the cleaning tool 100 generally comprises a brush head 102, a stem assembly 104 extending outwardly from the brush head 102, and a reinforcement member 106 configured to provide sufficient reinforcement so that the cleaning tool 100 can withstand greater force and stress than conventional pool brushes with metal backing. As illustrated in FIG. 1A, the brush head 102 comprises an elongate support base 108 having an upper surface 110, a lower surface 112, and interior and exterior side surfaces 114, 116. Bristles 118 extend from the lower surface 112 of the support base 108 at an angle relative to the stem assembly 104 to form a brush for scrubbing and removing dirt from walls and floors of swimming pools and the like. The stem assembly 104 has a generally tubular body 120 with one or more buttons 122 extending through openings 124 formed on the tubular body 120. As will be described in greater detail below, the buttons 122 are adapted to engage with corresponding openings on an elongate handle 126, such as a telescopic pole, to removably attach the handle to the cleaning tool 100.

Figure 1C:
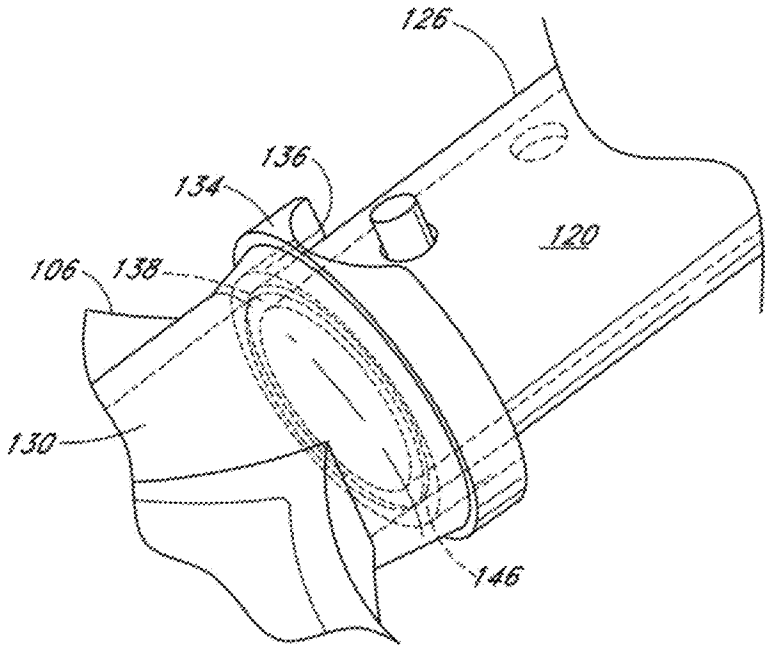
Figure 1B:
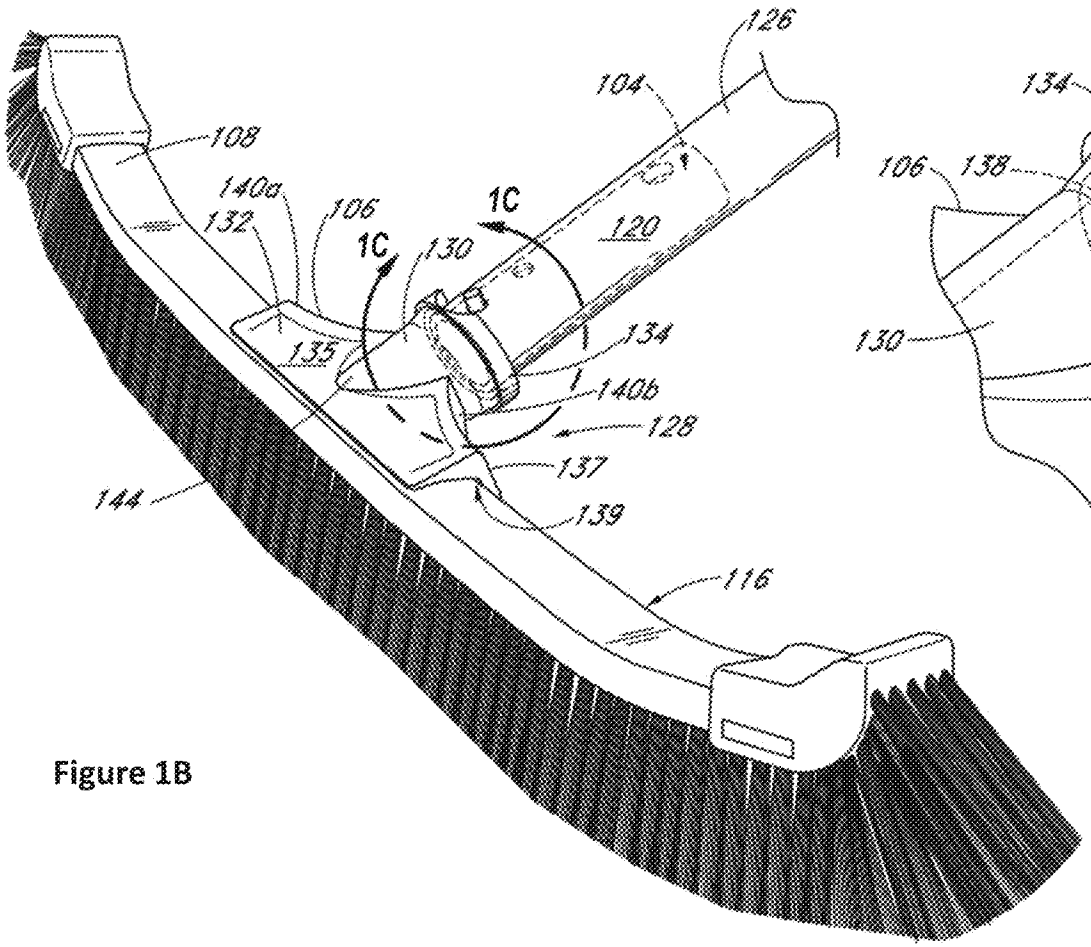

As illustrated in FIG. 1B, the reinforcement member 106 is configured to be positioned in the neck area 128 of the tool 100 where the support base 108 and the stem assembly 104 are joined. In one implementation, the reinforcement member 106 is configured with a collar portion 130 and an adjoining shell 132. The collar portion 130 is sized to circumscribe the tubular body 120 of the stem assembly 104 and has an apron 134 forming an annular space 136 around the tubular body 120. The annular space 136 is configured to receive a proximal end 138 of the elongate handle 126. As further illustrated in FIG. 1B, the shell 132 of the reinforcement member 106 is preferably configured to conform to the general contour of the neck area 128 of the tool 100. In one embodiment, the shell 132 comprises two sidewalls 135, 137 extending laterally from the collar portion 130 and disposed at an angle relative to each other forming a L-shaped channel 139 adapted to receive a portion of the upper 108 and inner side surface 116 of the support base 102. As shown in FIG. 1B, one sidewall 137 comprises two downwardly sloping surfaces 140*a*, 140*b* extending from opposing sides of the collar portion 130. Each of the two downwardly sloping surfaces 140*a*, 140*b* are preferably between about 1 mm to 4 mm wide.

In certain implementations, the reinforcement member 128 is configured with an opening, indentation, or protrusion 144 configured to facilitate installation or removal of the reinforcement member. In certain preferred implementations, the configuration and dimension of the reinforcement member is designed to improve the stress and force resistance and substitute the metal backs. When the reinforcement member 106 is coupled with the brush head 102, the reinforcement member 106 absorbs a certain amount of the force and stress applied to the brush head during use. Additionally, the first sidewall 135 of the reinforcement member is adapted to exert force against a span of the upper surface 110 of the support base 102 and the second sidewall 137 is adapted to exert force against a span of the interior sidewall 116 of the support base 102 so that the force and stress is diffused over a larger area. In one embodiment, the reinforcement member has a length of approximately 100 mm-150 mm and the shell has a thickness of between 1 mm to 10 mm, more preferably between 3 mm to 5 mm. In another embodiment, the reinforcement member has a length that is between 20% to 40% of the length of the support base. In another embodiment, the height of the reinforcement member is between about 50 mm to 100 mm.

As further shown in FIGS. 1B and 1C, the reinforcement member 106 is disposed in the neck area 128 of the tool 100 and adapted to receive the distal end 138 of the elongate handle 126. In one embodiment, the distal end 138 is inserted into the annular space 136 defined by the apron 134 of the reinforcement member and the stem assembly by about 1 mm-10 mm, more preferably between 2 mm-5 mm. In some embodiments, inserting the elongate handle 126 into the apron causes the force applied from the handle to be transferred to the reinforcement member as opposed to the brush head or neck portion. This in turn significantly reduces breakage of the brush head or neck portion. In one embodiment, a shoulder 146 is formed in the interior of the collar portion 130 at a point slightly below the apron 134, which serves as a stopper guide for insertion of the handle 126.

Figures 1D, 1E:
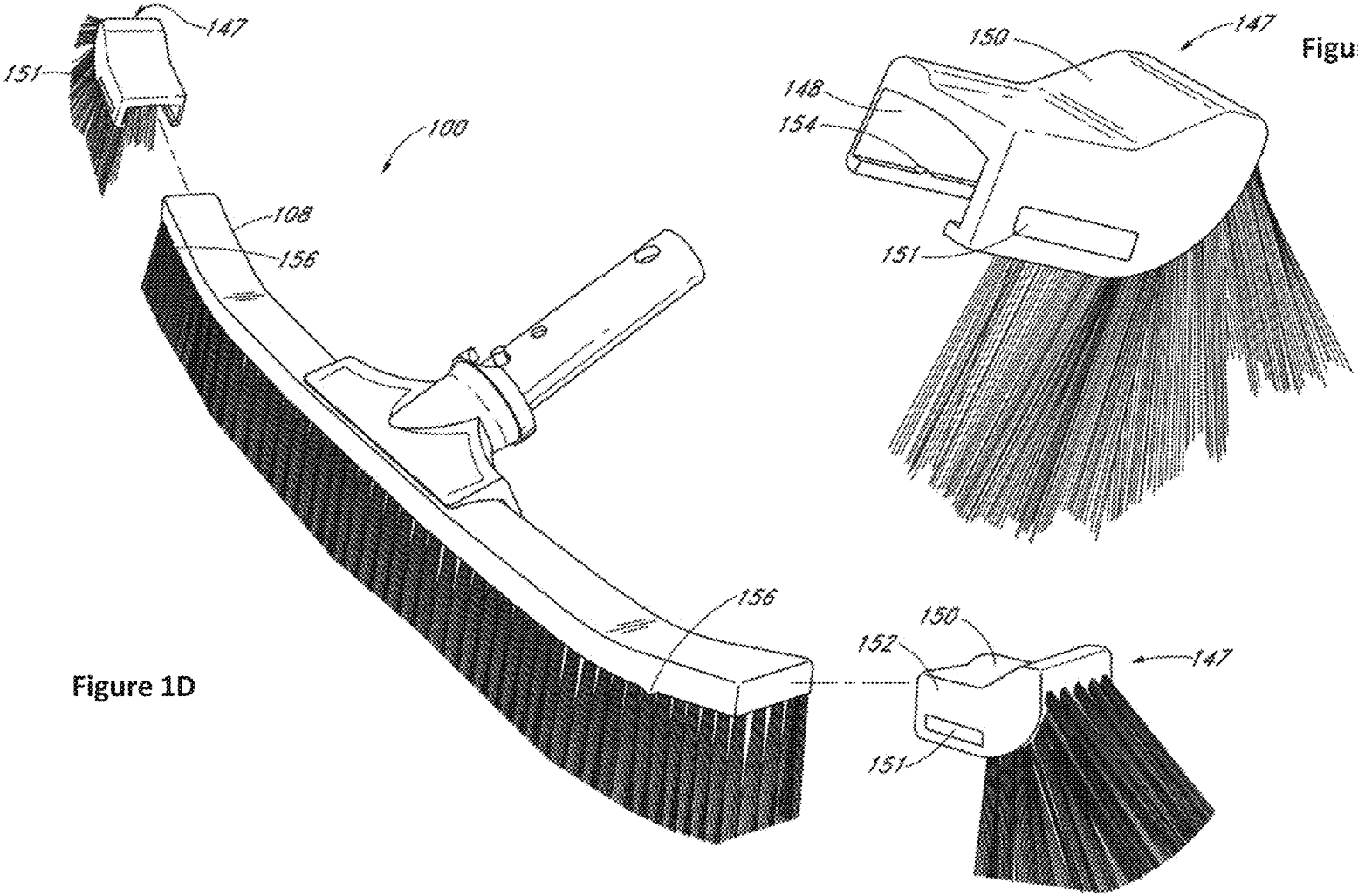
FIG. 1D illustrates an exploded view of the cleaning tool of FIG. 1A, with removable corner brushes being removed.
FIG. 1E is a detailed view of a removable corner brush of the cleaning tool of FIG. 1A, showing internal tracks adapted to slidably engage with a brush frame.

In some embodiments, as shown in FIG. 1D, the cleaning tool 100 further comprises removable corner brushes 147 that slidably engages with the end portions of the base support 108. In one implementation, each corner brush 147 comprises a U shaped track 148 and a upwardly curving support surface 150 from which bristles extend as shown in FIG. 1E. In some implementations, each corner brush 147 comprises one or more built-in magnetic attachments 151 adapted to pick up magnetic debris in water. Preferably, the magnetic attachments 151 are disposed on an exterior sidewall 152 of the corner brush 147. In some embodiments, magnetic attachments can also be disposed on the base support 108 of the brush head. In certain preferred implementations, a notch 154 or other location indicator is formed on the track of the corner brush 147 to engage with a corresponding notch 156 or other location indicator formed on the brush support 108 to secure the corner brush to the brush head at the desired location.

Additional details of cleaning tools that may be modified to incorporate any features disclosed herein are shown and described in U.S. Pat. No. 10,188,200, titled MODULAR DESIGNED POOL CLEANING TOOL, which is incorporated by reference herein in its entirety. Any embodiments disclosed herein may also be modified to incorporate any features of the embodiments disclosed in U.S. Pat. No. 10,188,200.

Example Pool Cleaning Tool with Adjustable Pressure Generation Mechanisms

Figure 2A:
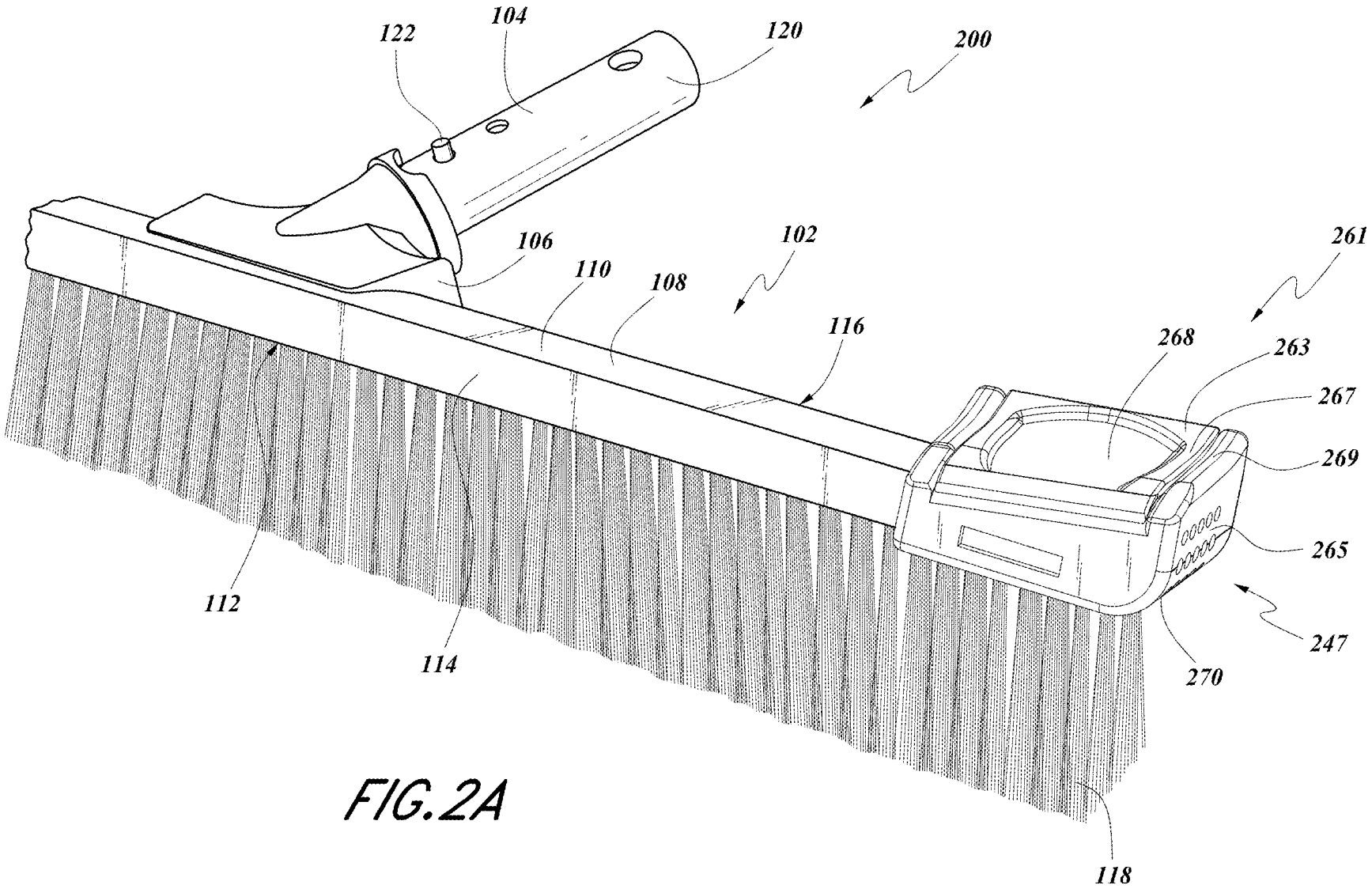
FIGS. 2A, 2B, and 2C illustrate perspective views of an embodiment of a cleaning tool having removable corner brushes that include an adjustable pressure mechanism.
Figure 2B:
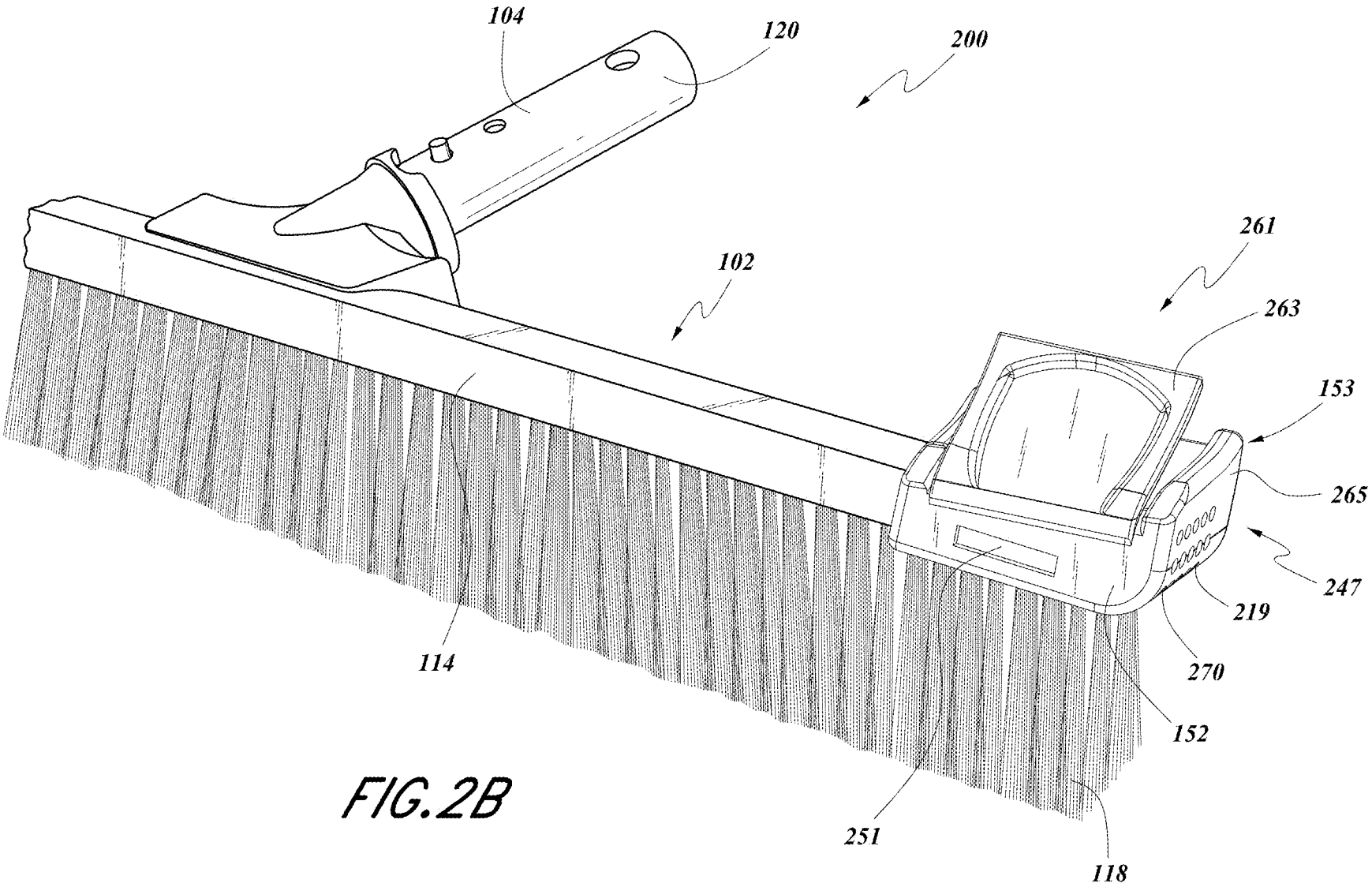
Figure 2C:
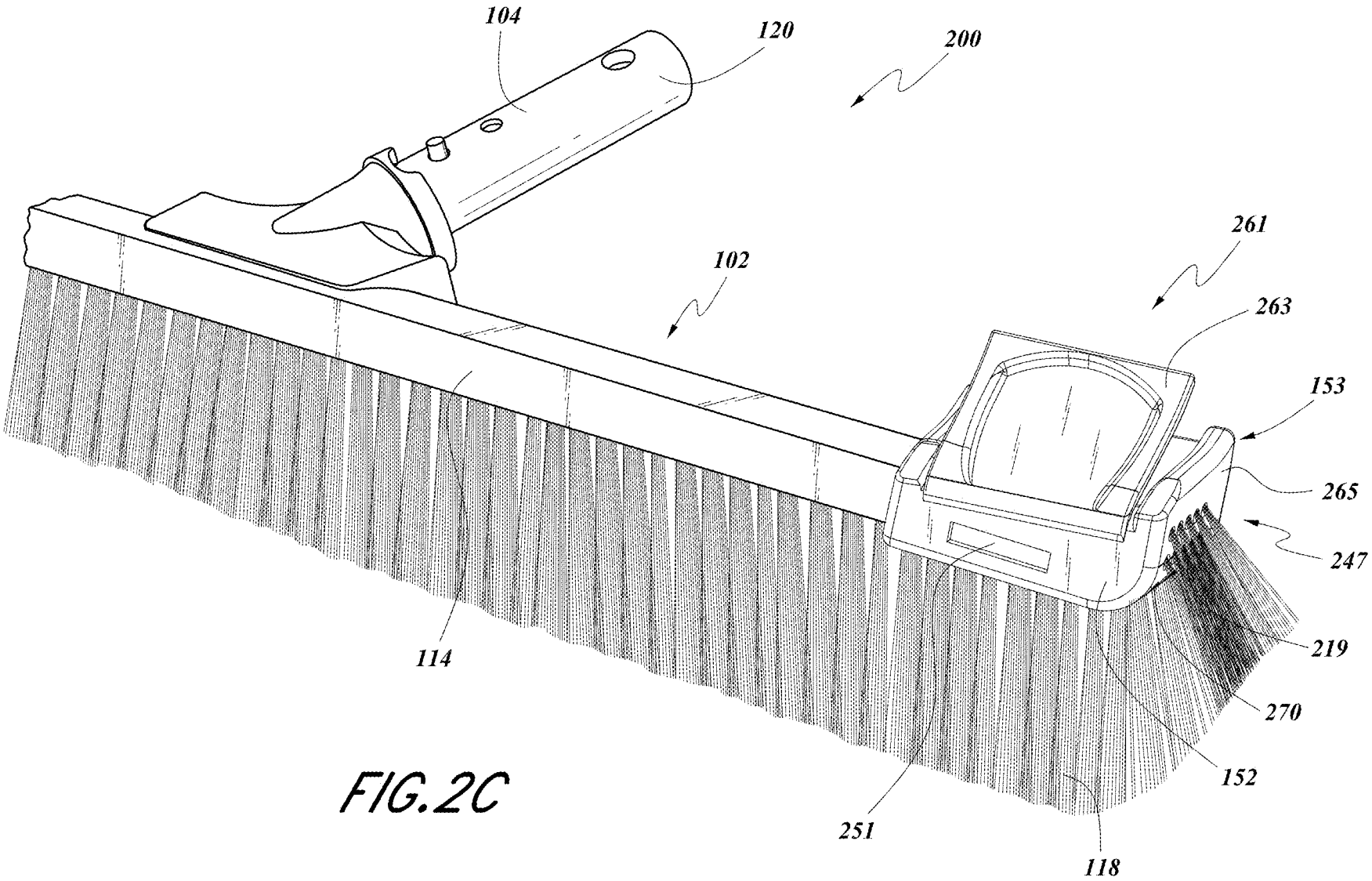

FIGS. 2A, 2B, and 2C illustrate partial perspective views of another embodiment of a cleaning tool 200. The cleaning tool 200 has a variety of similarities to the cleaning tool 100 of FIG. 1A, and the same or similar reference numbers are used to refer to the same or similar features. For example, the cleaning tool 200 comprises a brush head 102 attached to a stem assembly 104 and a reinforcement member 106. Further, although FIGS. 2A-2C only illustrate one half of the cleaning tool 200, the other half of the cleaning tool 200 may be essentially a mirror of the first half, similar to as shown in FIG. 1A.

One difference in the cleaning tool 200 from the cleaning tool 100 is that the elongate support base or frame 108 of the cleaning tool 200 is straight or substantially straight, whereas the elongate support base 108 of the cleaning tool 100 is shaped to curve upward at its ends. The concepts disclosed herein are not limited to any particular shape of the elongate support base 108, however, and the concepts disclosed herein, such as related to adjustable pressure mechanisms, may be used with any shape of support base 108.

Similar to the cleaning tool 100, the brush head 102 of the cleaning tool 200 comprises an elongate support base 108 that has an upper surface 110, lower surface 112, exterior side surface 114, and interior side surface 116. The brush head 102 further comprises a plurality of bristles 118 extending downward from the lower surface 112. In this embodiment, the bristles 118 extending from the elongate support base 108 extend in a direction that is generally parallel to the exterior and interior side surfaces 114, 116, and in a direction that is generally perpendicular to the upper and lower surfaces 110, 112. The disclosure is not limited to such a configuration, however.

Another difference in the cleaning tool 200 is that the cleaning tool 200 comprises removable corner brushes 247 at each end of the elongate support base or frame 108 that comprise different features and functionality than the removable corner brushes 147 of the cleaning tool 100. Although FIGS. 2A-2C only show one removable corner brush 247 at one end of the elongate support base 108, a similar removable corner brush (e.g., the same design but mirrored) may be positioned at the opposite end of the elongate support base 108 (for example, as discussed below with reference to FIG. 6A). The removable corner brushes 247 may have a plurality of bristles extending therefrom, similar to the bristles that extend from the removable corner brushes 147 of FIG. 1E. Those bristles are not shown in FIGS. 2A and 2B, but they are shown in FIG. 2C. Various figures for cleaning tool 200 illustrate a plurality of holes 219 in a lower surface 270 of a main body 265 of the removable corner brush 247. Those plurality of holes 219 may have bristles coupled thereto (as shown in FIG. 2C) in order to provide additional bristles, some of which may be oriented parallel to the plurality of bristles 118, and some of which may be oriented in different directions (as shown in FIG. 2C, and similar to as shown in FIG. 1E).

The removable corner brushes 247 further comprise an adjustable pressure mechanism or adjustable force generation mechanism 261. The adjustable pressure mechanism 261 is desirably configured to adjust an amount of downward force generated to force the bristles 118 (and/or bristles of the removable brush 247) against a surface being cleaned as the cleaning tool 200 is passed through water. To do so, the adjustable pressure mechanism 261 comprises a movable or rotatable pressure member 263 that is rotatably coupled to the main body 265 of the removable corner brush 247. As is described in greater detail below, the movable pressure member 263 is desirably pivotally coupled to the main body 265 at a forward end of the main body 265 (e.g., the end that includes exterior sidewall 152), in order to allow a rearward end of the movable pressure member 263 (e.g., the end positioned adjacent interior sidewall 153 of the main body 265) to move up and down with respect to the main body 265 and the upper surface 110 of the elongate support base 108, thus altering or adjusting a pitch or angle of the movable pressure member 263 with respect to the rest of the cleaning tool 200.

With reference to FIG. 2A, the movable pressure member 263 comprises an upper surface 267 that is desirably generally aligned with an upper surface 269 of the main body 265 when the movable pressure member 263 is in a lowermost or closed orientation (e.g., the orientation shown in FIG. 2A). In the lowermost or closed orientation, the movable pressure member 263 is desirably positioned to generate the lowest amount of pressure on the bristles 118 as the cleaning tool 200 is passed through the water. In some embodiments, the lowermost or closed orientation may be configured such that the movable pressure member 263 generates no force on the bristles 118 as the cleaning tool 200 is passed through the water. In some embodiments, however, at least some force is generated even in the lowermost or closed orientation (e.g., force directed generally perpendicular to the upper surface 110 of the elongate support base 108, and generally in line with the direction of extent of the bristles 118).

For example, the movable pressure member 263 comprises a recessed area 268 that is recessed below the upper surface 267. The recessed area 268 and/or the upper surface 267 may be shaped in a shape that will cause force to be generated as the cleaning tool 200 is passed through the water even when the movable pressure member 263 is in the lowermost or closed position. In this example, the shape or profile of the upper surface 267 and the recessed area 268 is generally an S-shaped profile (as can be seen, for example, in FIGS. 4E, 4F, and 4I). Other shapes or profiles may be utilized, including, for example, curved, concave, convex, flat, and/or the like. Further, some embodiments may not include the recessed area 268, and/or may include more than one recessed area 268. Additionally, in this embodiment, the upper surface 269 of the main body 265 is shaped to generally follow the same profile as the upper surface 267 of the movable pressure member 263, such that the upper surfaces 267 and 269 are aligned or substantially aligned in the lowermost or closed position. Other embodiments may not include such a configuration, however.

With reference to FIG. 2B, which shows the movable pressure member 263 in a raised or open position, the main body 265 of the removable corner brush 247 further includes an opening, cutout, or location 251 for insertion therein or attachment thereto of a magnet. This may be similar to the configuration described above with reference to FIGS. 1D and 1E that include magnetic attachments 151. Such a feature is not a requirement, however, and some embodiments may include an adjustable pressure mechanism 261 without such magnetic attachments.

It should be noted that, although the adjustable pressure mechanism 261 is illustrated in FIGS. 2A and 2B as being part of a removable corner brush 247, the concepts of such an adjustable pressure mechanism 261 may be utilized in configurations other than a removable corner brush. For example, in some embodiments, the corner brush 247 may be permanently affixed to the elongate support base 108, instead of being removable. Further, in some embodiments, the adjustable pressure mechanism 261 may be incorporated into or attached to the elongate support base 108 (removably or not removably) without being part of a corner brush (for example, as discussed below with reference to FIGS. 6B-6E). For example, the elongate support base 108 may be modified to include features that allow the movable pressure member 263 to be pivotally coupled to the elongate support base 108, a different main body may be used than the main body 265, such as a main body that does not include bristles or bristle holes 219, and/or the like.

Figure 3A:
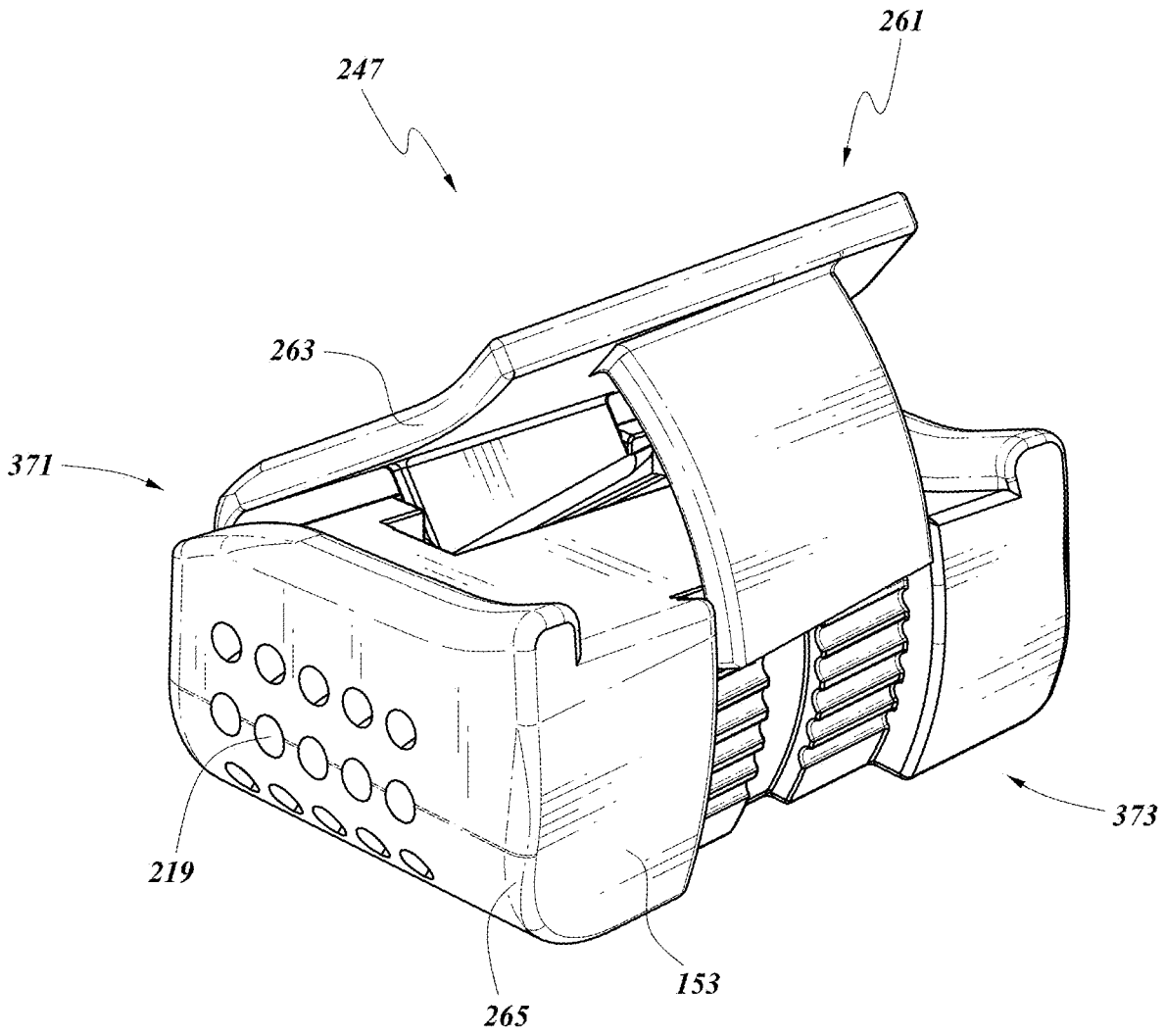
FIGS. 3A and 3B illustrate perspective views of a removable corner brush of the cleaning tool of FIG. 2A.
Figure 3B:
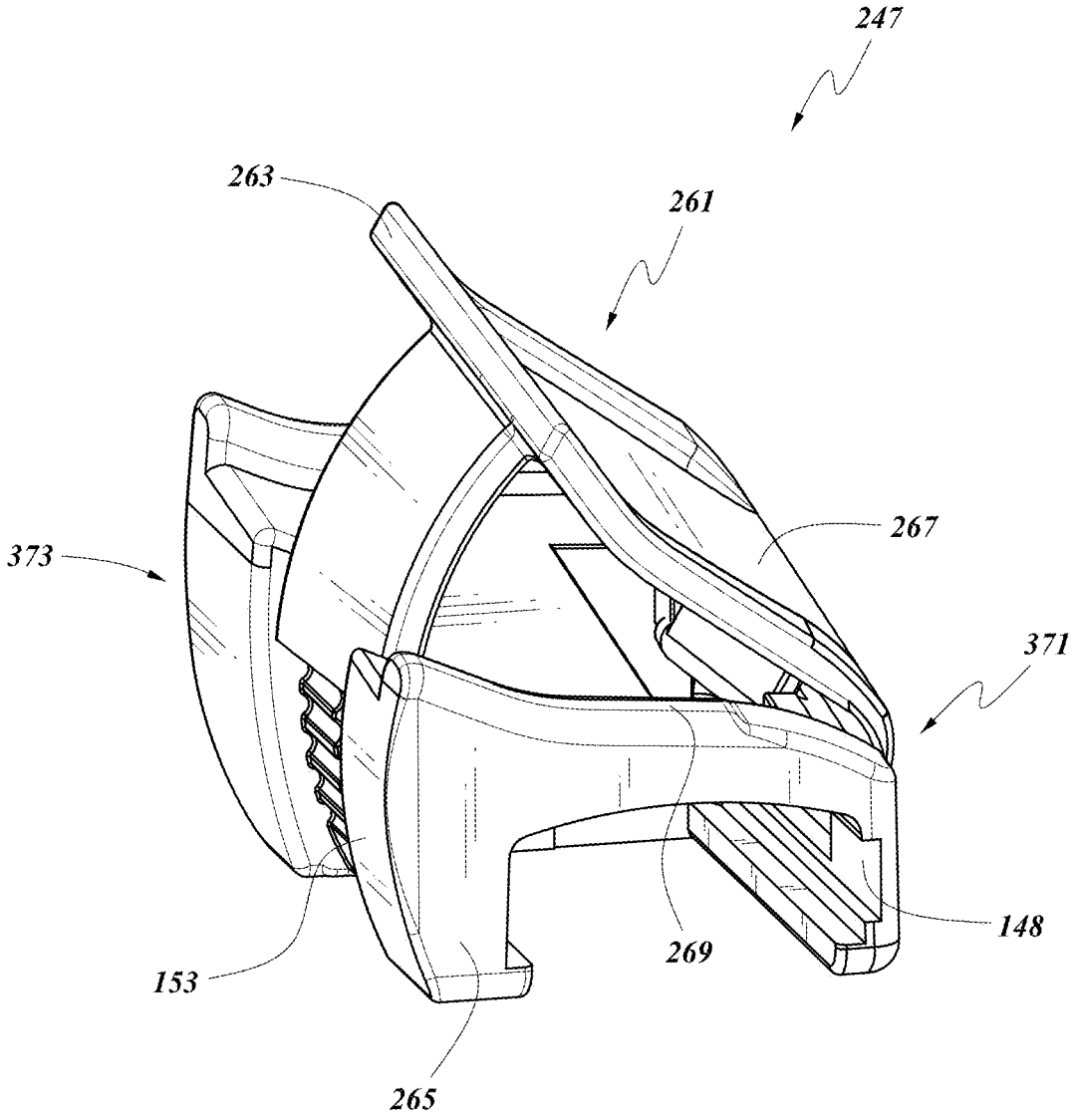

Turning now to FIGS. 3A and 3B, these figures illustrate perspective views of the removable corner brush 247 of FIG. 2A removed from the elongate support base 108 of the brush head 102. These figures also illustrate the movable pressure member 263 of the adjustable pressure mechanism 261 in the raised or open configuration or position, similar to as shown in FIG. 2B. Also, similar to as shown in FIGS. 2A and 2B, the removable corner brush 247 is shown without any bristles in the bristle holes 219.

FIGS. 3A and 3B further illustrate that the adjustable pressure mechanism 261 includes a pivot mechanism 371 at a forward or exterior end of the corner brush 247, and a locking mechanism 373 at a rearward or interior end of the corner brush 247. Further details of the features of the movable pressure member 263 and main body 265 that form the pivot mechanism 371 and locking mechanism 373 are described below.

FIG. 3B further illustrates that the main body 265 comprises a U-shaped track 148, which may be similar to the U-shaped track 148 of the corner brush 147 of FIG. 1E. Various other embodiments may attach the corner brush 247 to the elongate support base 108 differently.

Movable Pressure Member

Figure 4A:
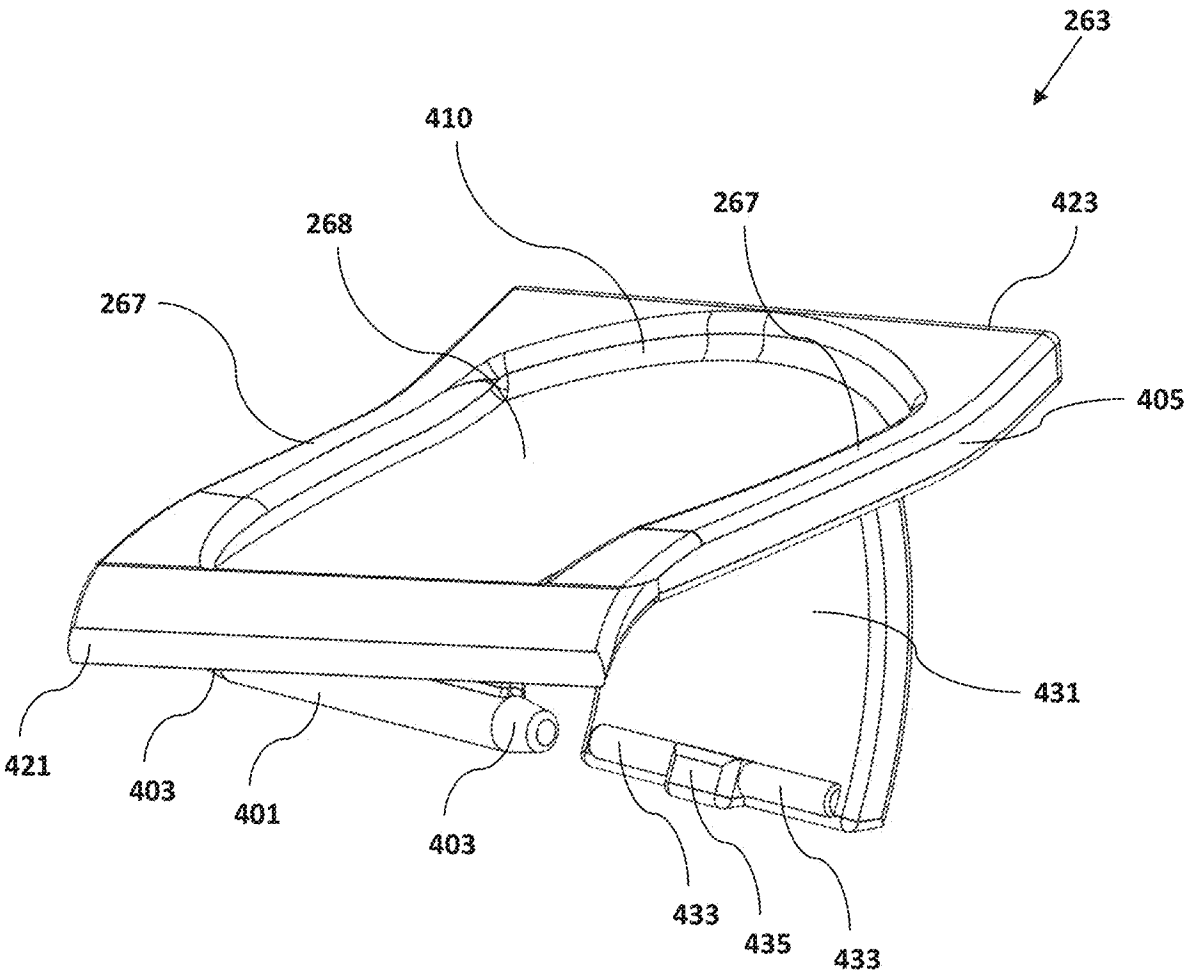
Figure 4B:
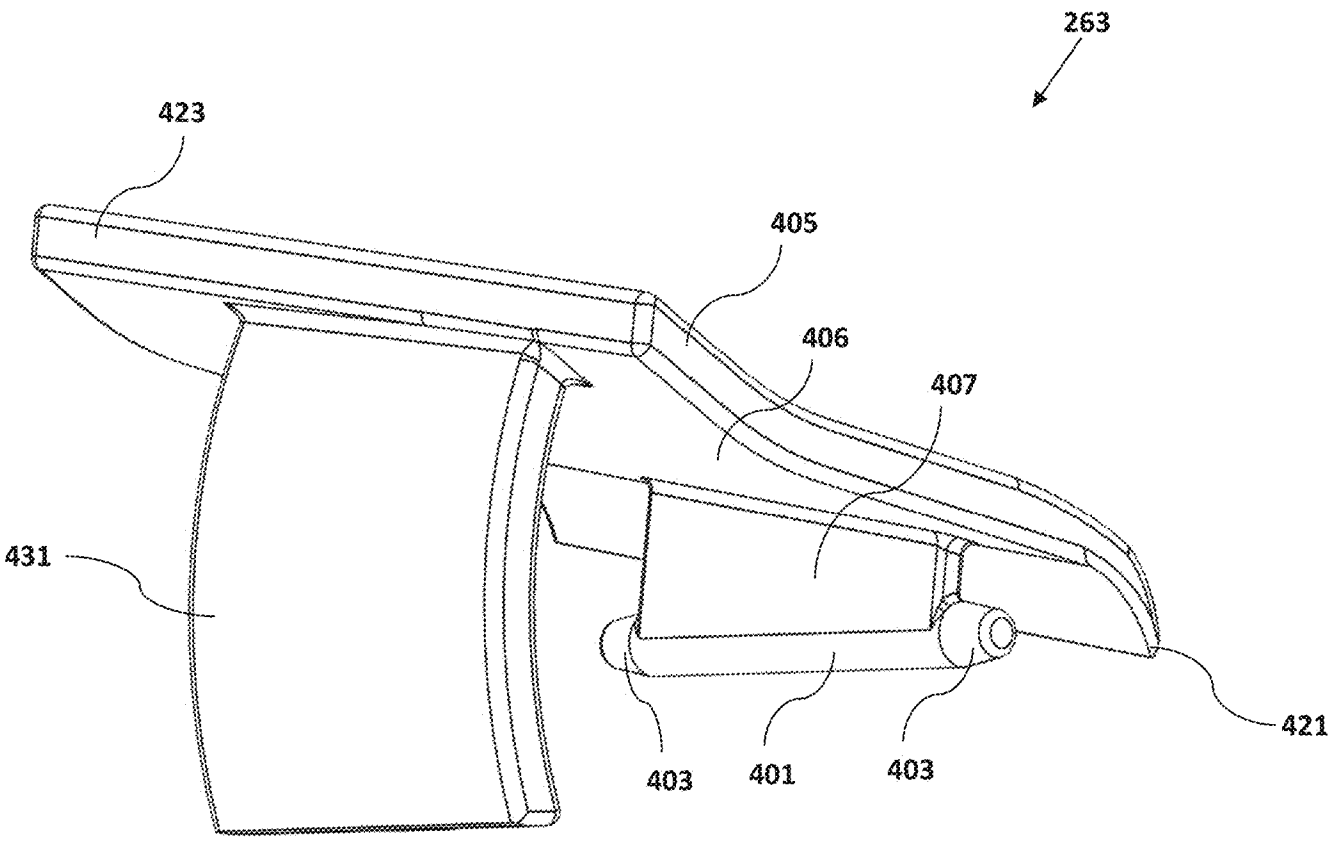
Figure 4D:
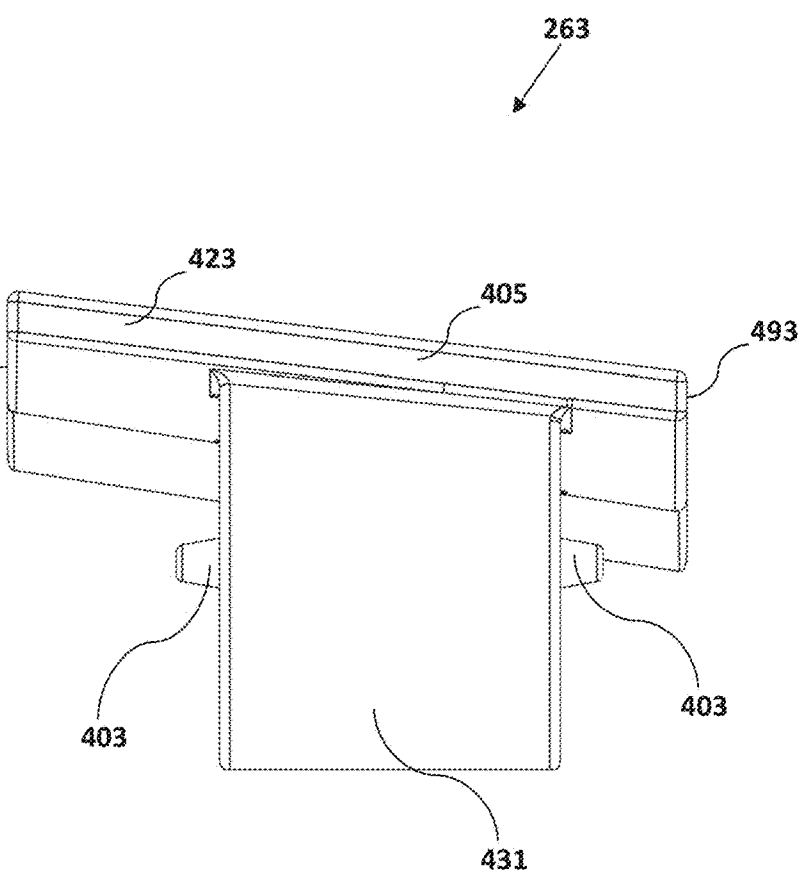
Figure 4C:
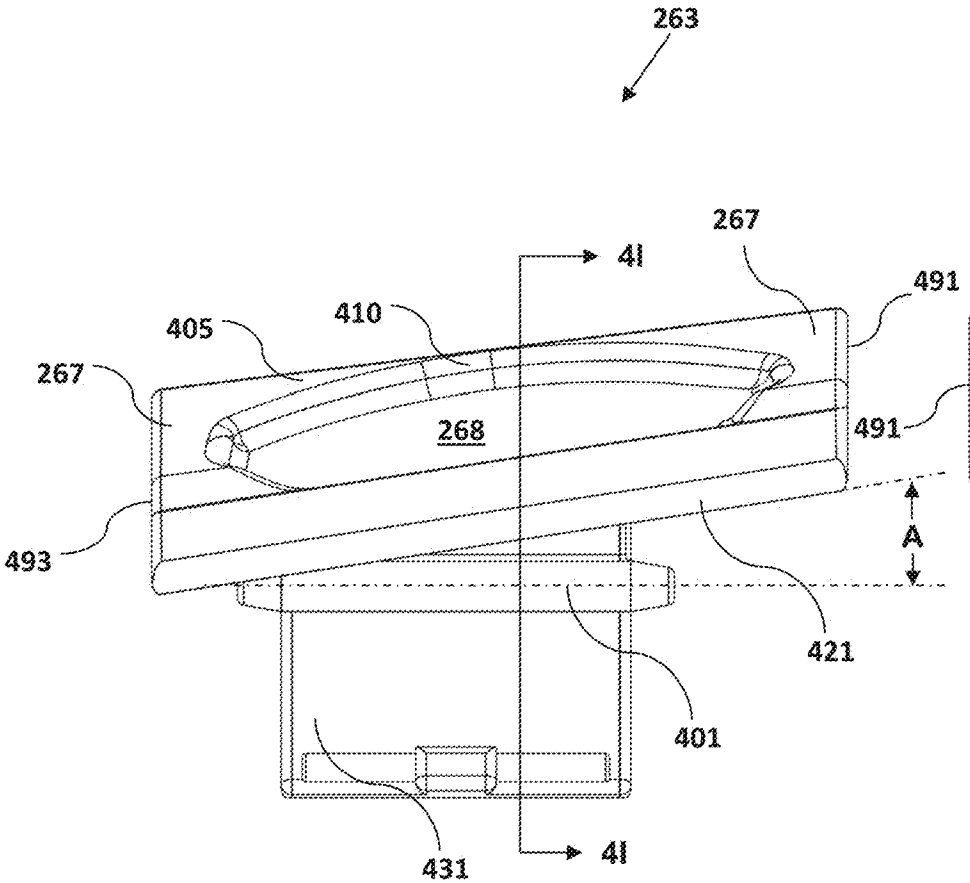
Figure 4F:
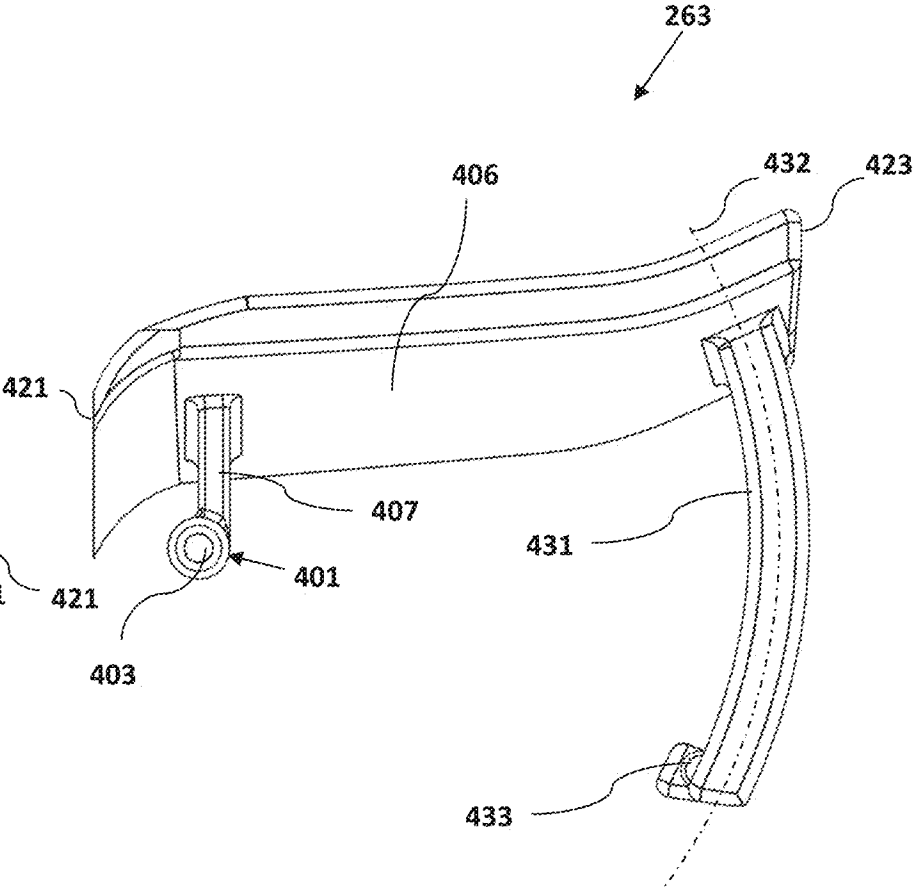
Figure 4E:
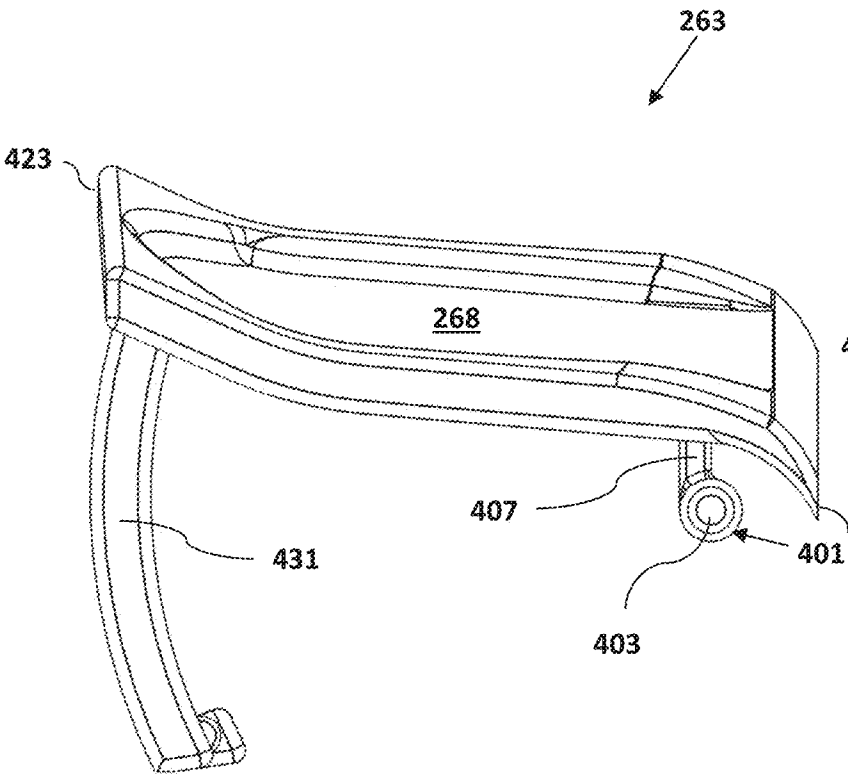
Figure 4H:
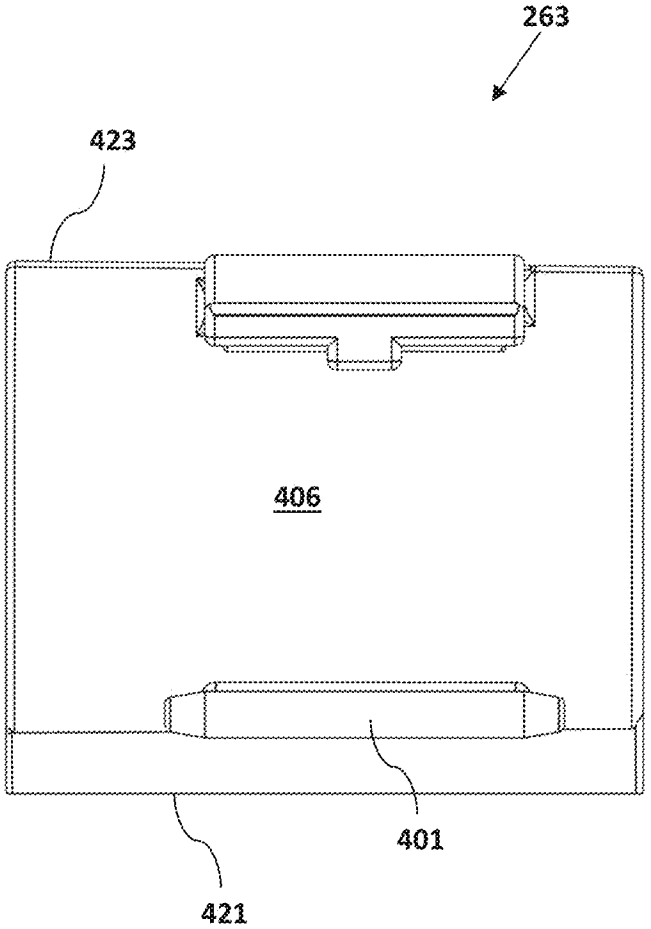
Figure 4G:
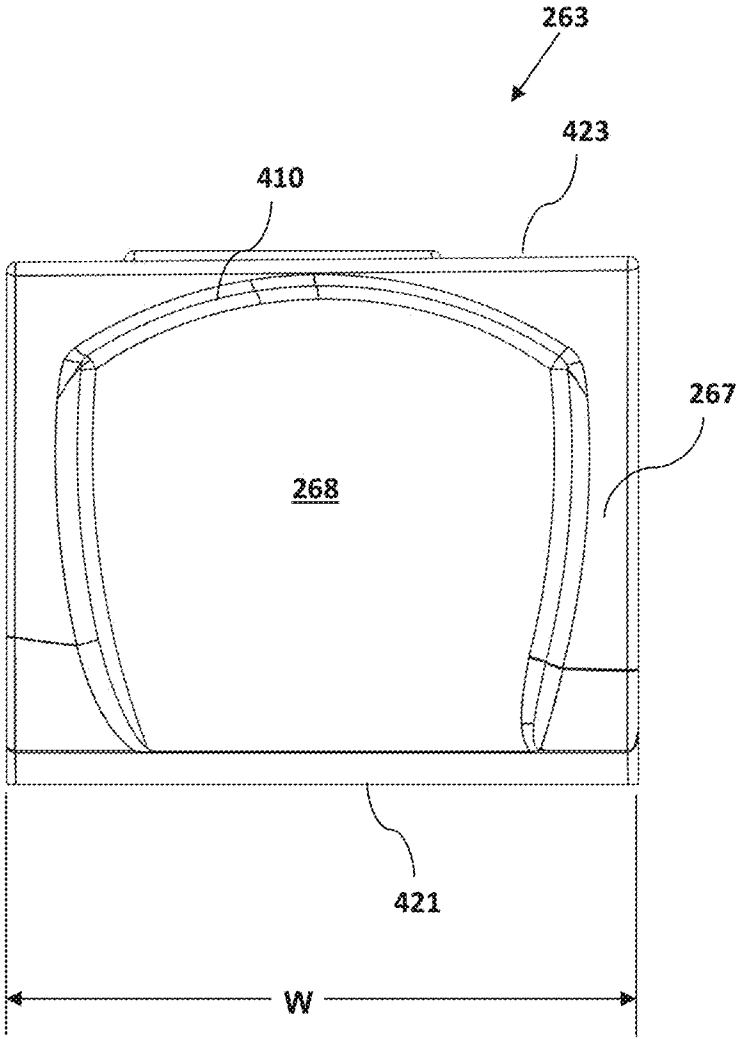
Figure 41:
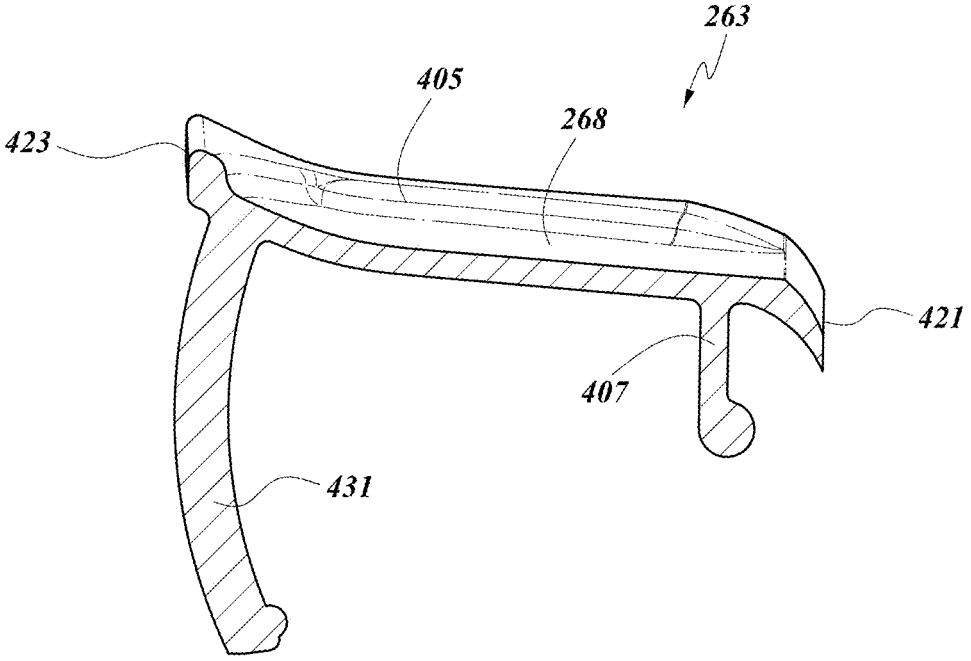

FIGS. 4A-4I illustrate various views of the movable pressure member 263 of the adjustable pressure mechanism 261 of the removable corner brush 247 of FIG. 2A. FIGS. 4A and 4B are perspective views thereof, FIGS. 4C and 4D are exterior and interior side views thereof, respectively, FIGS. 4E and 4F are end views thereof, FIGS. 4G and 4H are top and bottom views thereof, respectively, and FIG. 4 I is a cross-sectional view thereof.

With reference to FIGS. 4A and 4B, the movable pressure member 263 comprises an upper member 405 that extends from a front end or exterior end 421 to a rear end or interior end 423. The upper member 405 is shaped in a generally S-shaped profile, as can be further seen in FIGS. 4E, 4F, and 4I, although other shapes or profiles may be used. Further, the upper member 405 comprises a recessed area 268 that is recessed with respect to the upper surface 267. In some embodiments, the upper member 405 comprises a transition area 410 that smoothly transitions from the upper surface 267 to the recessed area 268. Such a smooth transition can be desirable, for example, to reduce or avoid generating turbulence in the water as the movable pressure member 263 is passed through the water during a cleaning procedure.

The front end 421 of the upper member 405 comprises a connecting member 407 extending generally downward from a lower surface 406 of the upper member 405 (see FIG. 4B). At a distal end of the connecting member 407 is a hinge pin, shaft, or member 401 having round tapered protrusions 403 extending from each end thereof. The hinge pin 401 desirably defines the pivot axis or rotation axis of the movable pressure member 263 with respect to the main body 265. For example, the protrusions 403 may be configured to mate with and rotate with respect to corresponding concave or curved hinge surfaces 504 shown in FIG. 5B.

With continued reference to FIGS. 4A and 4B, the movable pressure member 263 further comprises an elongate curved member 431 extending downward from the lower surface 406 of the upper member 405 at the rear end 423 of the upper member 405. At a distal end of the elongate curve member 431 are two rounded protruding members 433 and another protruding member or extension limiting member 435. The protruding members 433 may be configured to mate with corresponding recesses, notches, detents, and/or the like 534 of the main body 265 (shown in FIG. 5B). By including a plurality of recesses 534 positioned adjacent to one another, the protruding members 433 can be positioned within and/or engaged with any pair of recesses 534 to retain or lock the upper member 405 in a particular orientation with respect to the main body 265.

The protruding member or extension limiting member 435 can be configured to, for example, limit the upward rotation of the upper member 405 with respect to the body 265. For example, the protruding member 435 may be configured to engage an extension stop surface 537 of the main body 265 (see FIG. 5B) when the upper member 405 is rotated to or beyond a fully open or uppermost position with respect to the main body 265. Although such a feature is not required, such a feature can be beneficial, for example, such as to avoid a user accidentally rotating the upper member 405 too far and completely disengaging the locking mechanism 373 (see FIGS. 3A and 3B).

With continued reference to FIGS. 4A and 4B, in some embodiments, the protruding members 433 desirably extend along an axis that is parallel to an axis along which the hinge pin 401 extends. In other embodiments, the protruding members 433 may extend along a different direction and/or may take a different form. It can be desirable, however, for the protruding members 433 to be rounded, inclined, and/or the like, such as to make it easier for a user to slide the protruding members 433 into and out of the various recesses 534 of the main body 265. It is not necessarily required in some embodiments that the protruding members 433 comprise a rounded, inclined, and/or the like surface, however. For example, some embodiments may be configured such that the elongate curve member 431 has enough flexibility in it that a user can relatively easily pull the protruding members 433 sufficiently away from the recesses 534 to pivot the movable pressure member 263 with respect to the main body 265. It can be desirable, however, to use a rounded and/or inclined surface of the protruding members 433 that cooperates with a corresponding rounded or inclined surface of the recesses 534 to eliminate the need of a user to hold the distal end of the elongate curve member 431 away from the recesses 534 (e.g., in a direction perpendicular to the axis of the hinge pin 401), or at least to reduce the amount of outward pulling needed by the user.

Turning now to FIGS. 4C and 4D, it can be seen in these figures that the upper member 405 is oriented at an angle A to the rotational axis defined by the hinge pin 401. In this embodiment, the angle A is such that an outer end 491 of the upper member 405 is positioned higher than an inner end 493 of the upper member 405. Specifically, in this embodiment, the angle A is approximately 8°. Other embodiments may utilize a different angle, such as approximately, at least, or no more than 5°, 6°, 7°, 8°, 9°, 10°, 11°, 12°, 13°, 14°, or 15°. In some embodiments, the angle A is desirably within a range of 5° to 10°. Such a configuration may be desirable, for example, to help control the force generated by the adjustable pressure mechanisms as the brush is passed through the water. For example, due to manufacturing tolerances, minor differences in assembly, and/or the like, the amount of force generated on the bristles by the adjustable pressure mechanisms at each end of the brush head may not be identical as a user passes the brush head through the water. By angling the upper members 405 inward (e.g., the upper surfaces of the upper members 405 are each oriented at least partially toward a center of the brush head defined by the stem assembly 104) any such small variations in force generated by the two adjustable pressure mechanisms may be relatively easy to control and/or may not even be noticeable to the user of the cleaning tool. On the other hand, if the upper members 405 were not positioned at an angle with respect to the elongate support base 108, or were angled oppositely (e.g., angled outwardly) with respect to the elongate support base, any such small variations in force generated by the two adjustable pressure mechanisms may be harder to control and/or may result in the cleaning tool tending to move the left or right while passing through the water, requiring more correction by the user. Accordingly, it can be desirable for the upper members 405 to be angled inward, as shown in FIGS. 4C and 4D, although such a configuration is not a requirement. This concept can be analogized to the toe alignment of the front wheels of a vehicle, where it is often desirable to have at least a slight inward toe alignment, instead of having the front wheels be perfectly parallel to one another.

Turning now to FIGS. 4E and 4F, these figures illustrate inner and outer end views of the movable pressure member 263, respectively. These views are oriented perpendicular to the pivot axis or rotation axis defined by the hinge pin 401. Desirably, the elongate curved member 431 extends along an arc shape 432. The arc 432 desirably comprises a radius that positions the center point of the arc 432 at or near the pivot axis defined by hinge pin 401. Such a design can be desirable, for example, to create a compact and easy to use assembly, and/or to conform to the similar arc shape of the main body 265, as discussed below with reference to FIG. 5J. Other embodiments may utilize a different radius for the arc shape 432, and other embodiments may not utilize an arc shape.

Turning now to FIG. 4I, FIG. 4I is a cross-sectional view of the movable pressure member 263, taken along the section plane shown in FIG. 4C. This cross-section illustrates more detail of the shape of the recessed area 268, which, as discussed above, is desirably generally S-shaped. Other shapes may be used, such as flat, curved, convex, concave, and/or the like. Desirably, the shape of the recessed area 268 is configured to reduce or minimize turbulence in the water as the cleaning tool is passed through the water.

Main Body

Figure 5A:
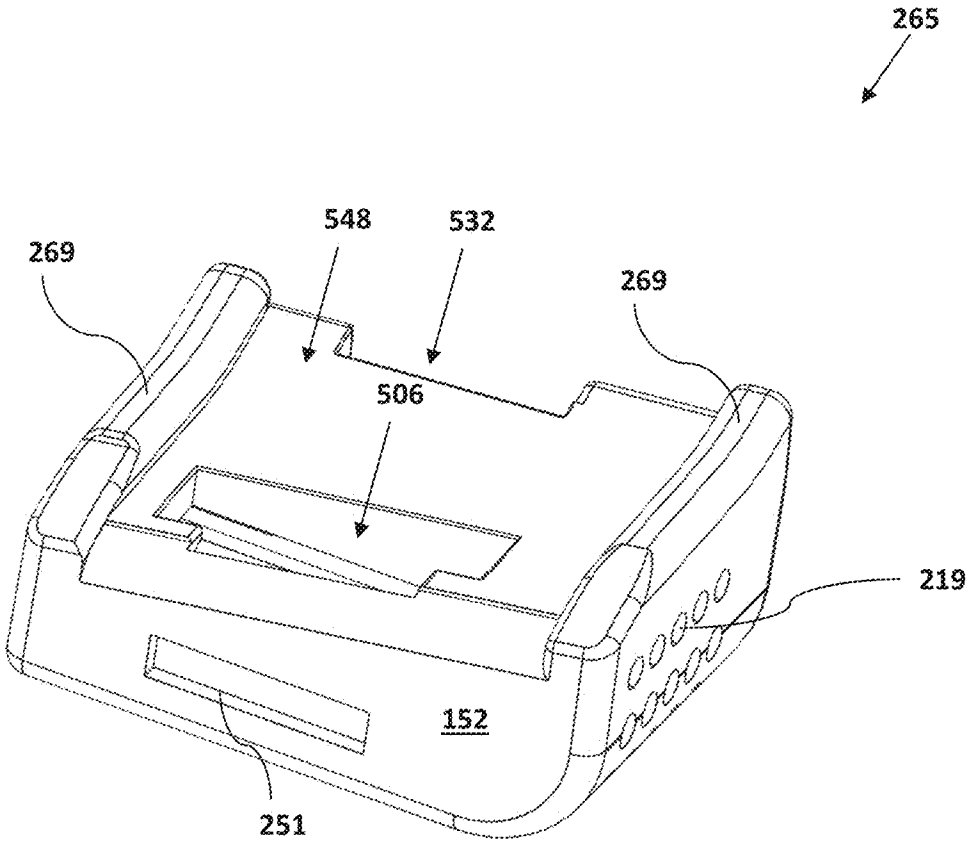
FIGS. 5A-5J illustrate various views of a body of the removable corner brush of FIG. 3A.
Figure 5B:
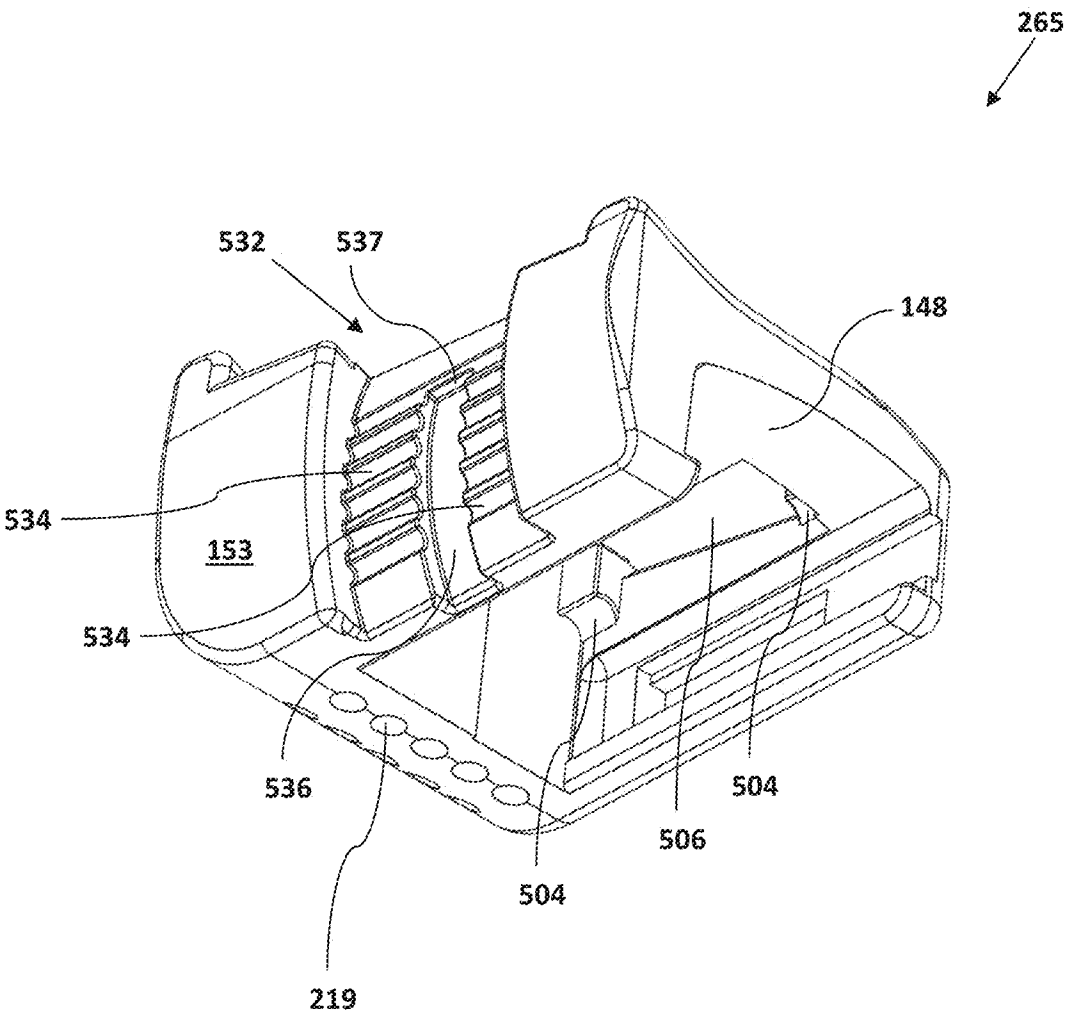
Figure 5D:
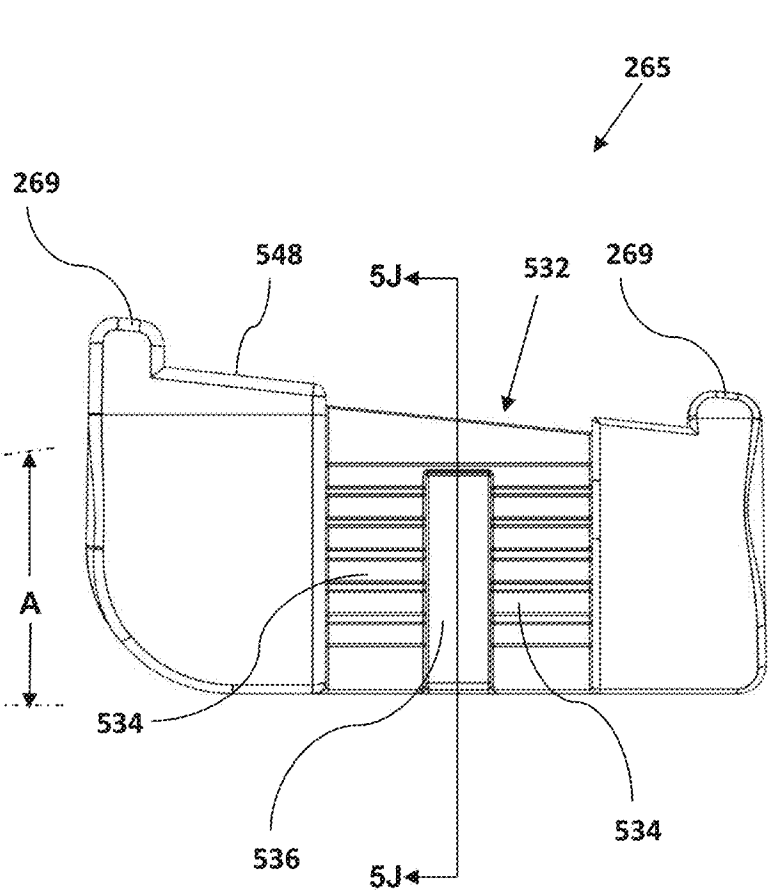
Figure 5C:
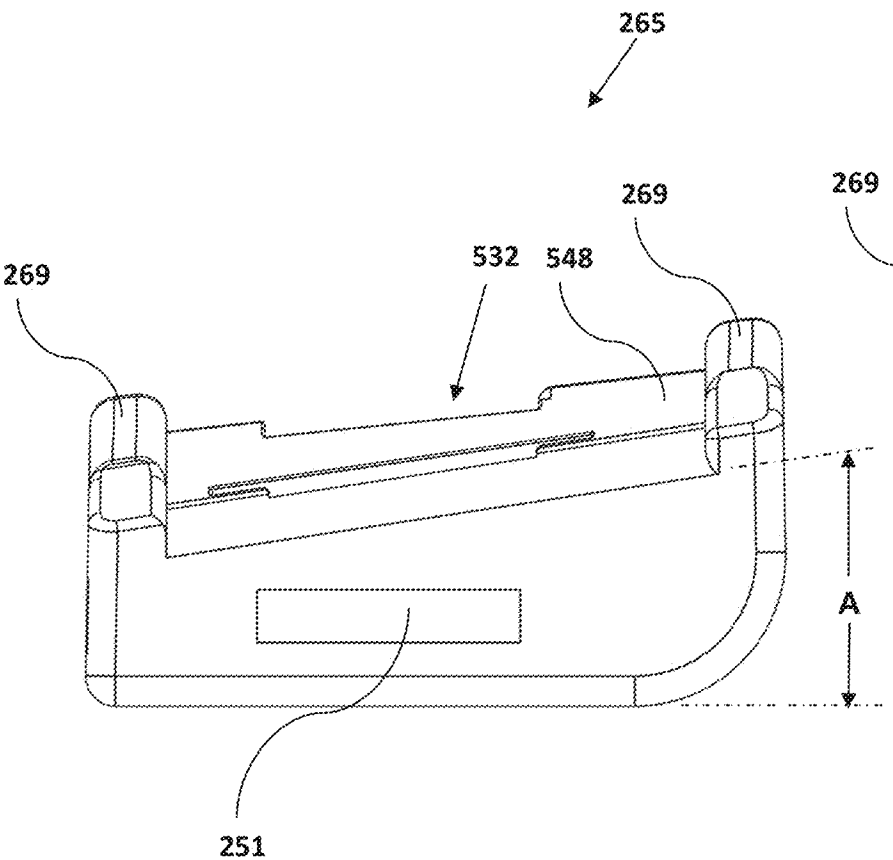
Figure 5F:
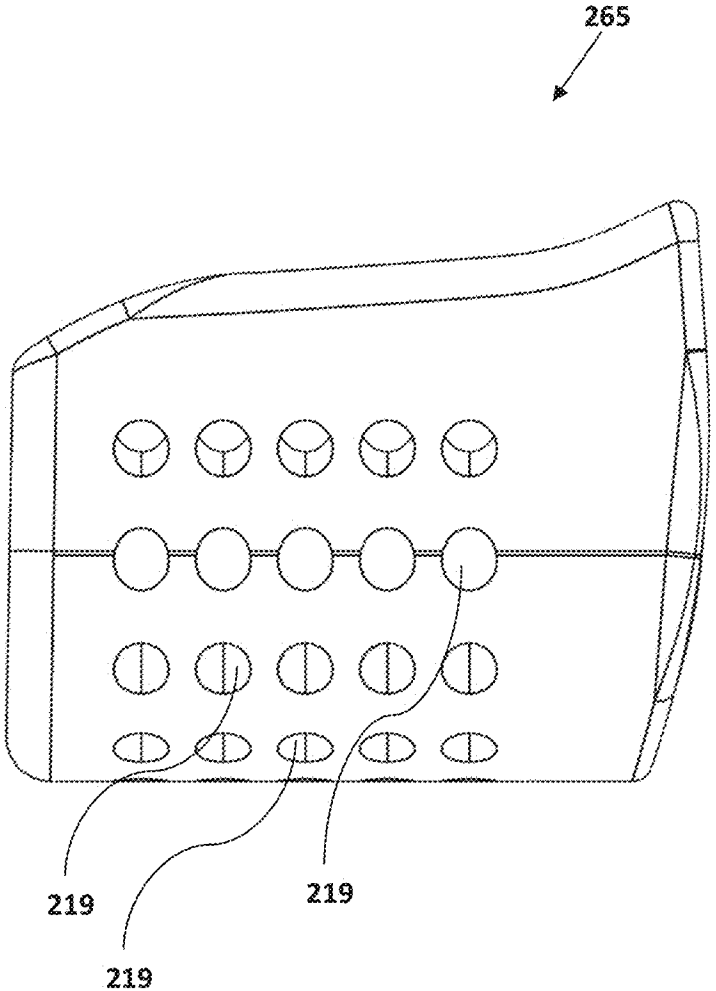
Figure 5E:
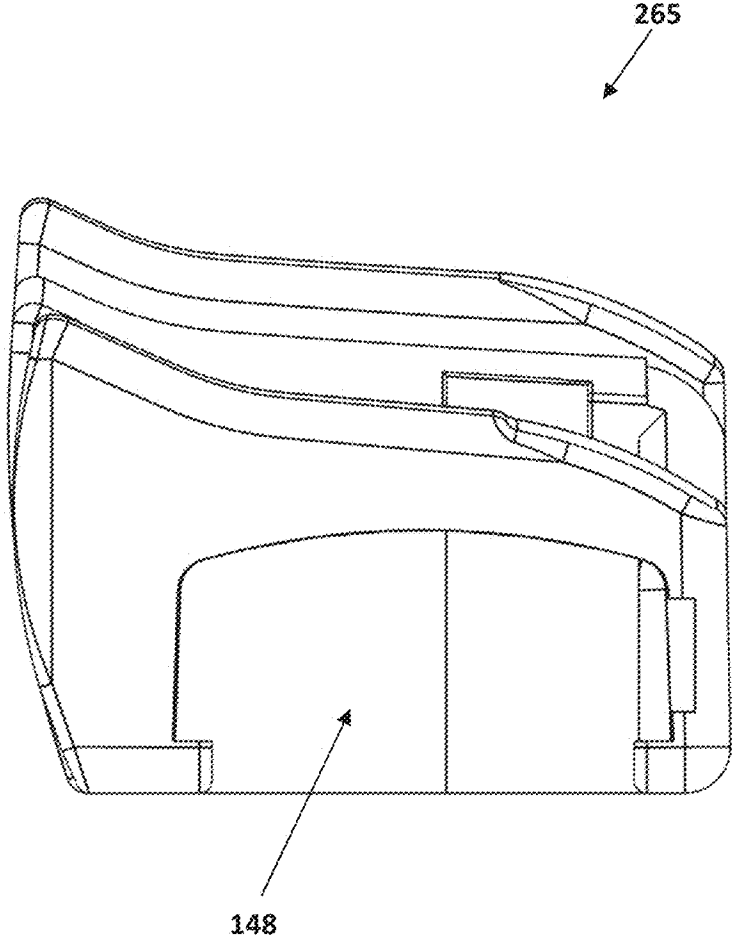
Figure 5H:
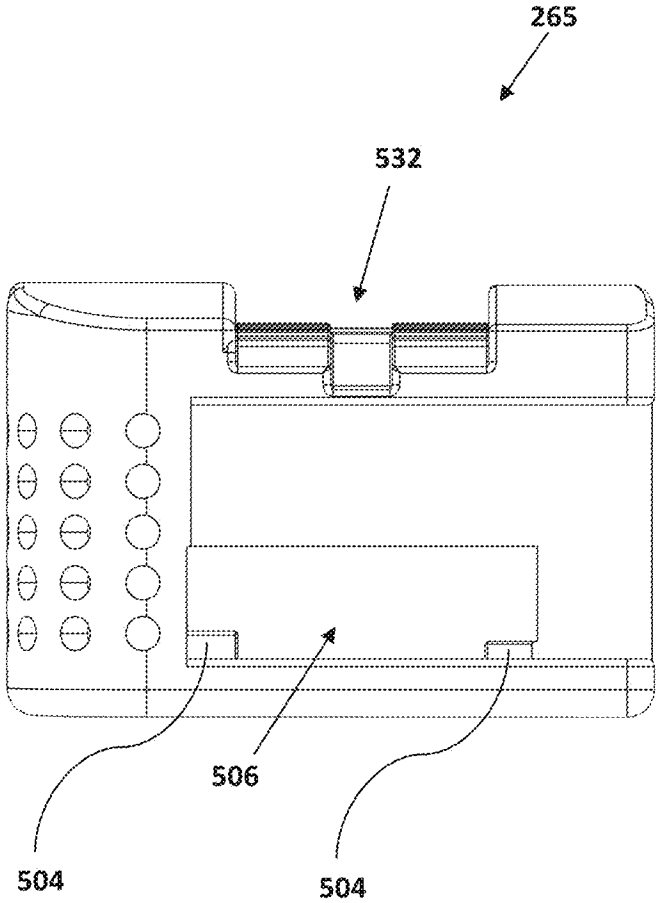
Figure 5G:
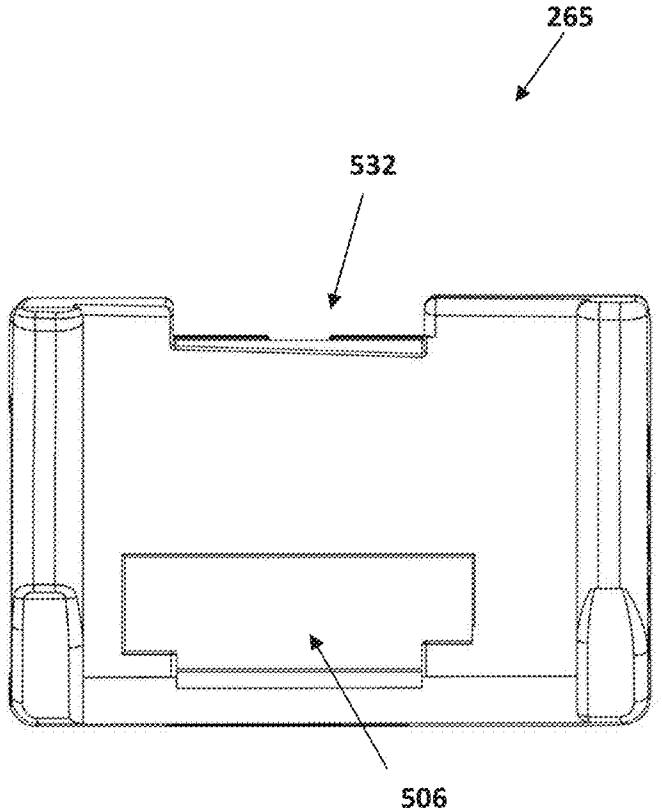
Figure 5I:
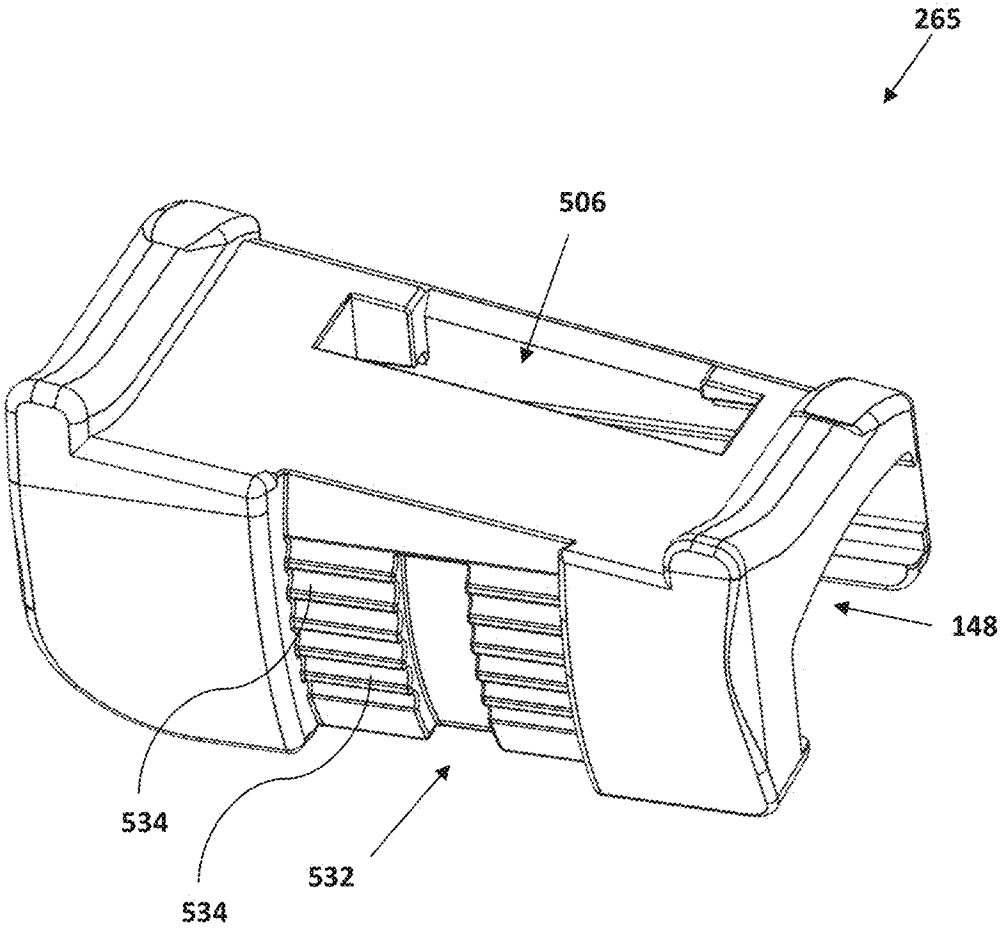
Figure 5J:
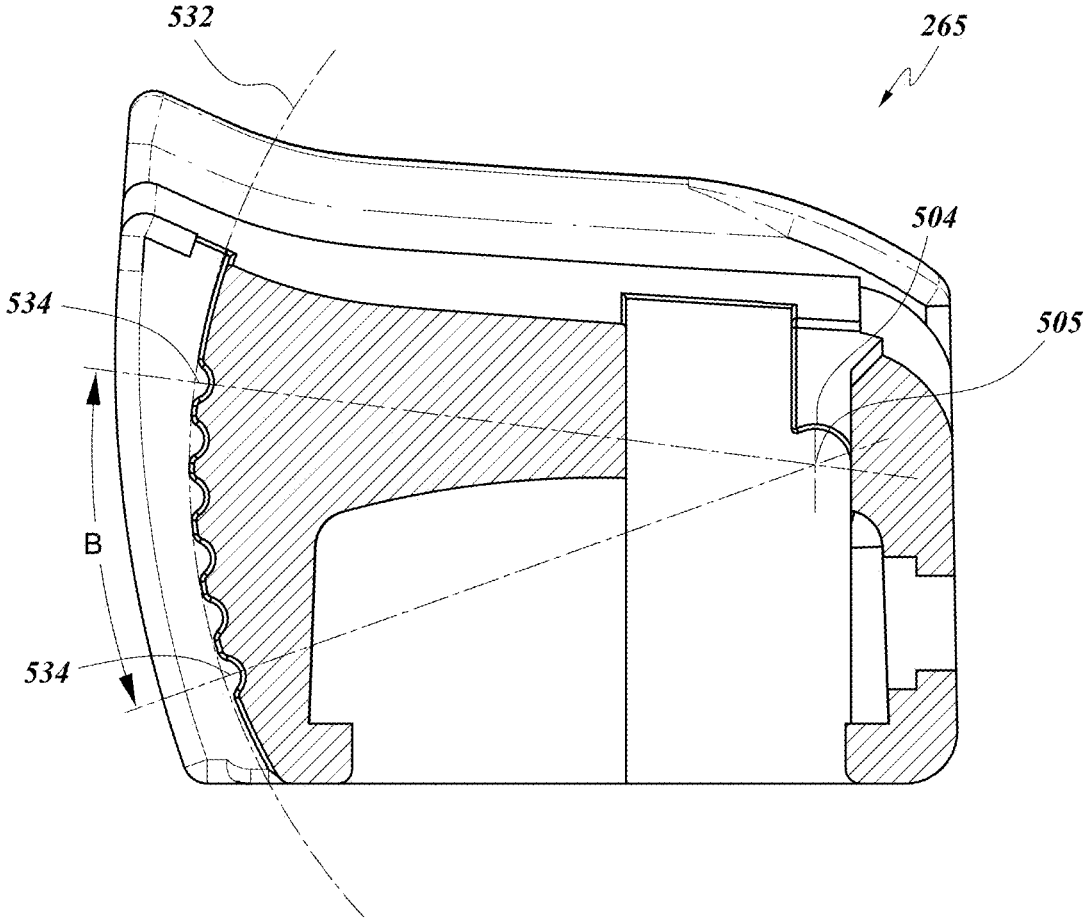

FIGS. 5A through 5J illustrate various views of the main body 265 of the removable brush 247 of FIG. 2A. FIGS. 5A and 5B are perspective views thereof, FIGS. 5C and 5D are exterior side and interior side views thereof, respectively, FIGS. 5E and 5F are inner and outer end views thereof, respectively, FIGS. 5G and 5H are top and bottom views thereof, respectively, FIG. 5E is another perspective view thereof, and FIG. 5J is a cross-sectional view thereof.

With reference to FIGS. 5A and 5B, the main body 265 comprises a recess or recessed area 548 positioned between the upper surfaces 269. The recessed area 548 can be shaped to have the upper member 405 of the movable pressure member 263 positioned substantially therein in the lowered or closed position (as shown in FIG. 2A). The main body 265 further comprises an opening 506 for positioning therein of the hinge pin 401 and connecting member 407 of the movable pressure member 263 (see FIG. 4B). The main body 265 further comprises a recess or opening 532 for positioning therein of the elongate curve member 431 of the movable pressure member 263 (see FIG. 4B).

With reference to FIG. 5B, the main body 265 further comprises a plurality of recesses, notches, or detents 534 positioned within the recess or opening 532. In this embodiment, the recesses 534 comprise a plurality of parallel and adjacent rounded depressions that are positioned along an arc shaped path (see arc shaped path 532 of FIG. 5J). With reference to FIGS. 5B and 5J, the concave or curved hinge surfaces 504 that desirably engage the protrusions 403 of hinge pin 401 define a pivot or rotation axis 505. Desirably, the arc shaped path 532 that the recesses 534 extend along is sized such that the arc shaped path's center point is aligned with the rotation axis 505. This can be desirable, for example, to enable the protrusions 433 of the movable pressure member 263 (see FIG. 4F) to engage each of the recesses 534 with the same amount of pressure. For example, if the arc shaped path 532 did not have its center of rotation aligned with the rotational axis 505, the protrusions 433 may experience greater or less pressure against each of the recesses 534 as the protrusions 433 are moved to different recesses 534. Accordingly, it can be desirable for the arc shaped path 532 to be aligned with the rotation axis 505, although such a feature is not a requirement.

With continued reference to FIG. 5J, this embodiment comprises six discrete positions that the movable pressure member 263 can be oriented in (corresponding to six discrete positions defined by the recesses 534). When the protruding member 433 of the elongate curved member 431 is positioned in the lowermost recess 534, that corresponds to the movable pressure member 263 being in the lowermost or closed position. When the protruding member 433 of the elongate curved member 431 is positioned in the uppermost recess 534, that corresponds to the movable pressure member 263 being in the uppermost or most open position. In the embodiment illustrated in FIG. 5J, the recesses 534 are each separated by approximately 5° with reference to the rotation axis 505, and thus the total range of adjustability from the closed position to the most open position is approximately 25°. Other embodiments may use different configurations. For example, each discrete position or detent may be separated by more or less than 5°, such as within a range of 1 to 10°, 2 to 8°, 3 to 6°, and/or the like. As another example, the total range of adjustability may be within a range of 10 to 40°, 10 to 30°, 5 to 30°, 15 to 30°, 20 to 30°, 20 to 40°, and/or the like.

Turning now to FIGS. 5C and 5D, it can be seen that the recessed area 548 of the main body 265 can also be oriented at an angle A, similar to the orientation of angle A for the movable pressure member 263 shown in FIG. 4C. Any angle described above with reference to angle A for the movable pressure member 263 may also apply to angle A of FIG. 5C. In some embodiments, it is desirable that angle A of FIG. 5C be equal to angle A of FIG. 4C.

Example Pressure Generation Mechanism Configurations

Figure 6A:
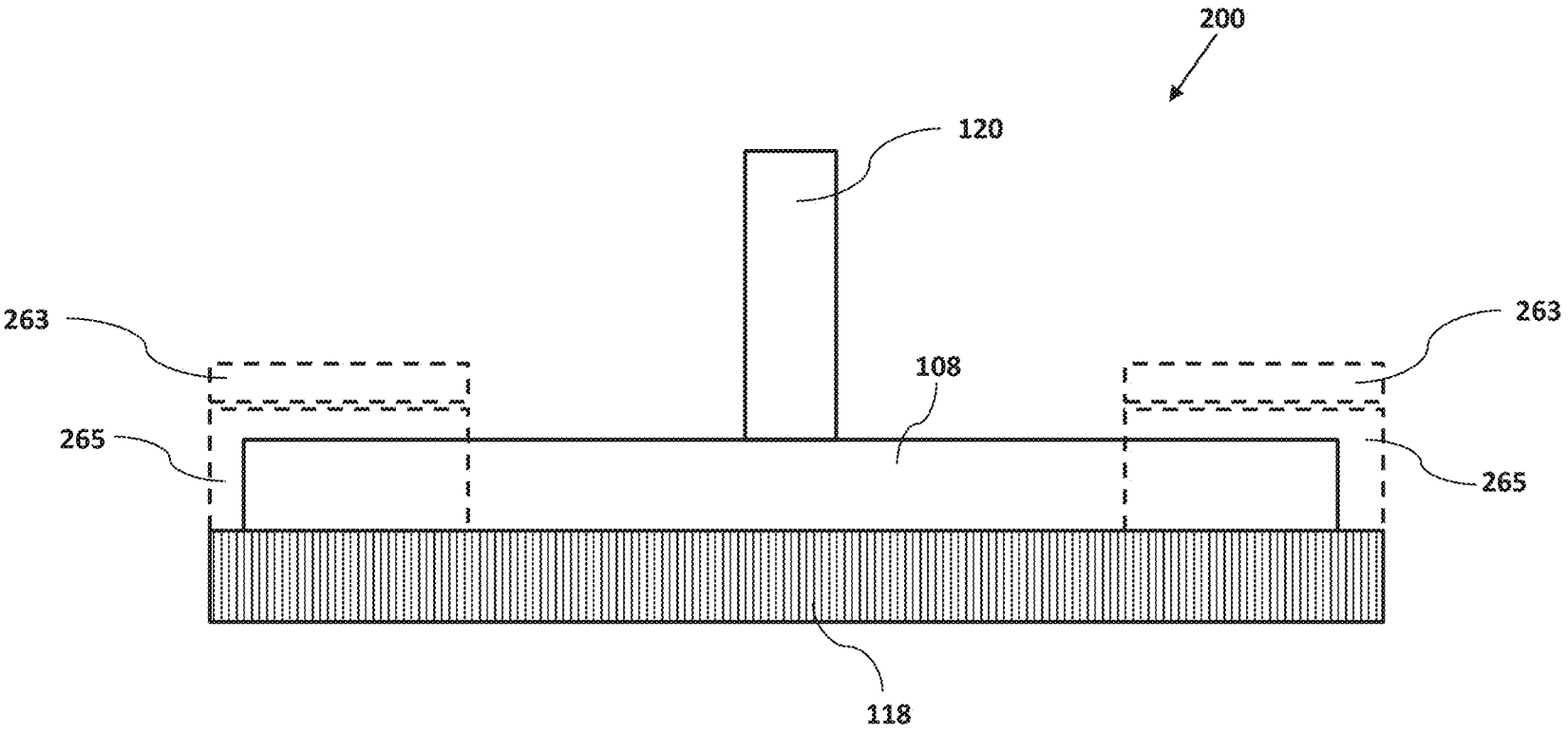
FIGS. 6A-6E are schematic diagrams of various embodiments of cleaning tools.

FIGS. 6A-6E are schematic diagrams illustrating a variety of configurations of the pressure generation mechanisms of the pool cleaning tool 200. For example, FIG. 6A illustrates schematically the version of the cleaning tool 200 shown in FIGS. 2A-2C. Specifically, the cleaning tool 200 comprises a tubular body 120 attached to a support base 108, a main body 265 at either end of the support base 108, a movable pressure member 263 movably coupled (pivotably or otherwise) to each of the two main bodies 265, and a plurality of bristles 118 extending from both the support base 108 and the main bodies 265. In this and other schematic views the bristles 118 are depicted extending all parallel to one another, but other configurations of the bristles 118 may be used.

Figure 6B:
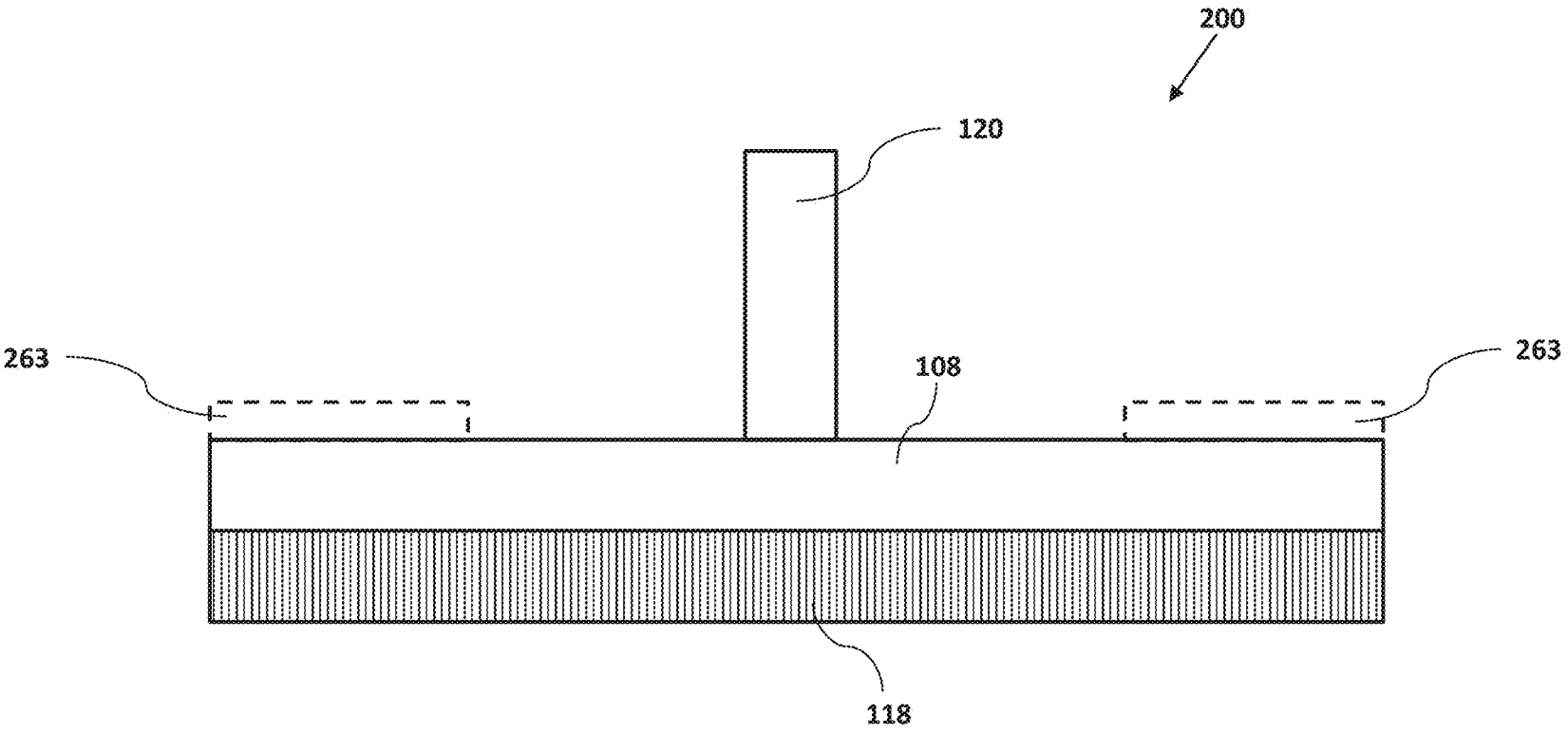
Figure 6C:
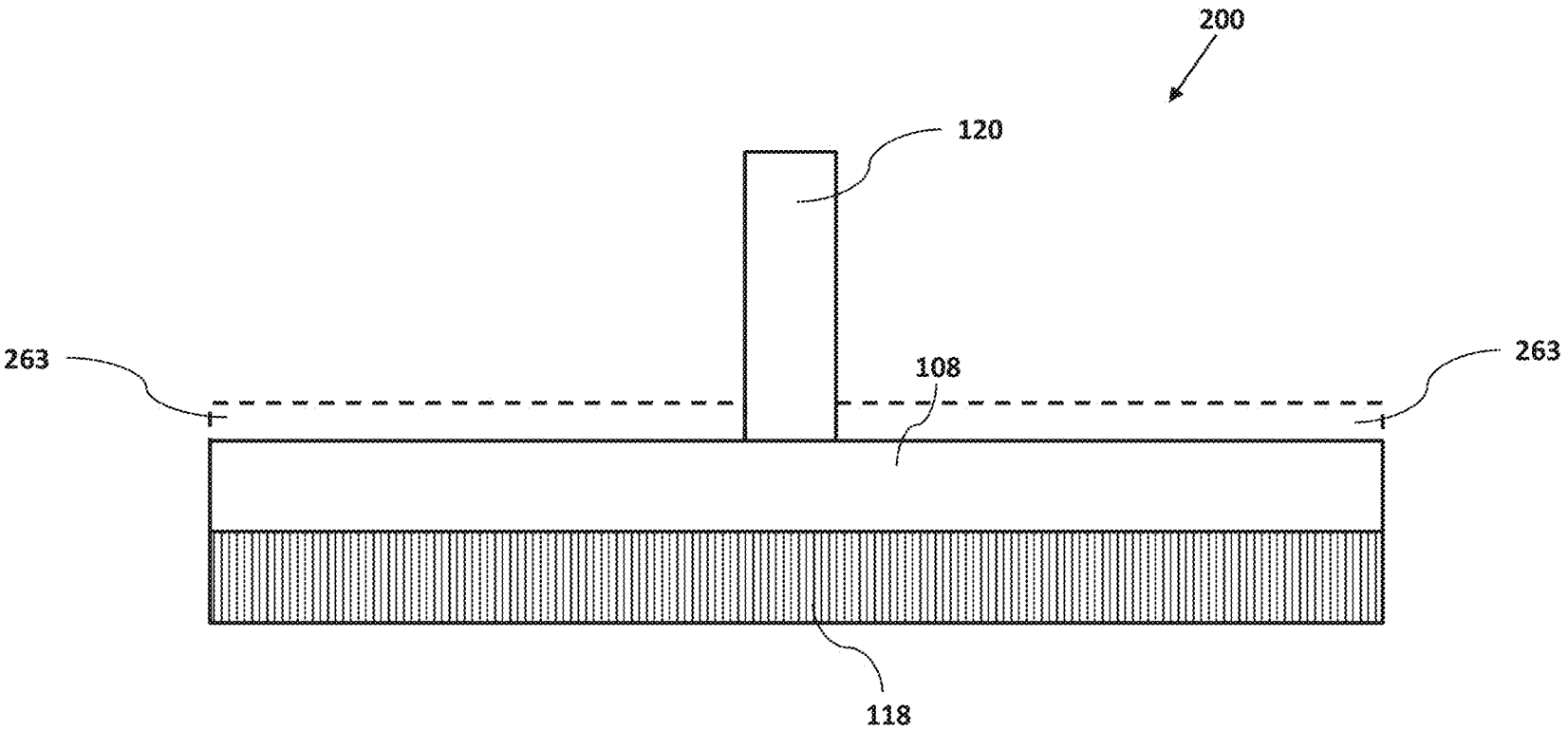

FIG. 6B illustrates a variation on the cleaning tool 200 that movably couples the movable pressure members 263 directly to the support base 108 instead of through the main bodies 265. For example, the support base 108 may include sockets, pins, slots, and/or the like that allow the pressure members 263 to movably couple thereto. FIG. 6C illustrates another variation on the cleaning tool 200 that is similar to the version of FIG. 6B, except that the movable pressure members 263 are much wider than as shown in the version of FIG. 6B. In this version, each of the two movable pressure members 263 desirably extends from an end of the support base 108 to the tubular body 120. In some embodiments, the two movable pressure members 263 may be combined into a single movable pressure member that may, for example, have a cutout at the middle for the tubular body 120. Various lengths of the movable pressure members 263 may be used. For example, measuring along the length of the support base 108, from the end of the support base 108 to the tubular body 120, a movable pressure member 263 may be configured to take up at least 10%, 20%, 30%, 40%, 50%, 60%, 80%, 90%, or 100% of that length. Further, in some embodiments, such as the embodiment shown in FIG. 6A, the movable pressure member 263 may at least partially extend beyond the end of the support base 108.

Figure 6D:
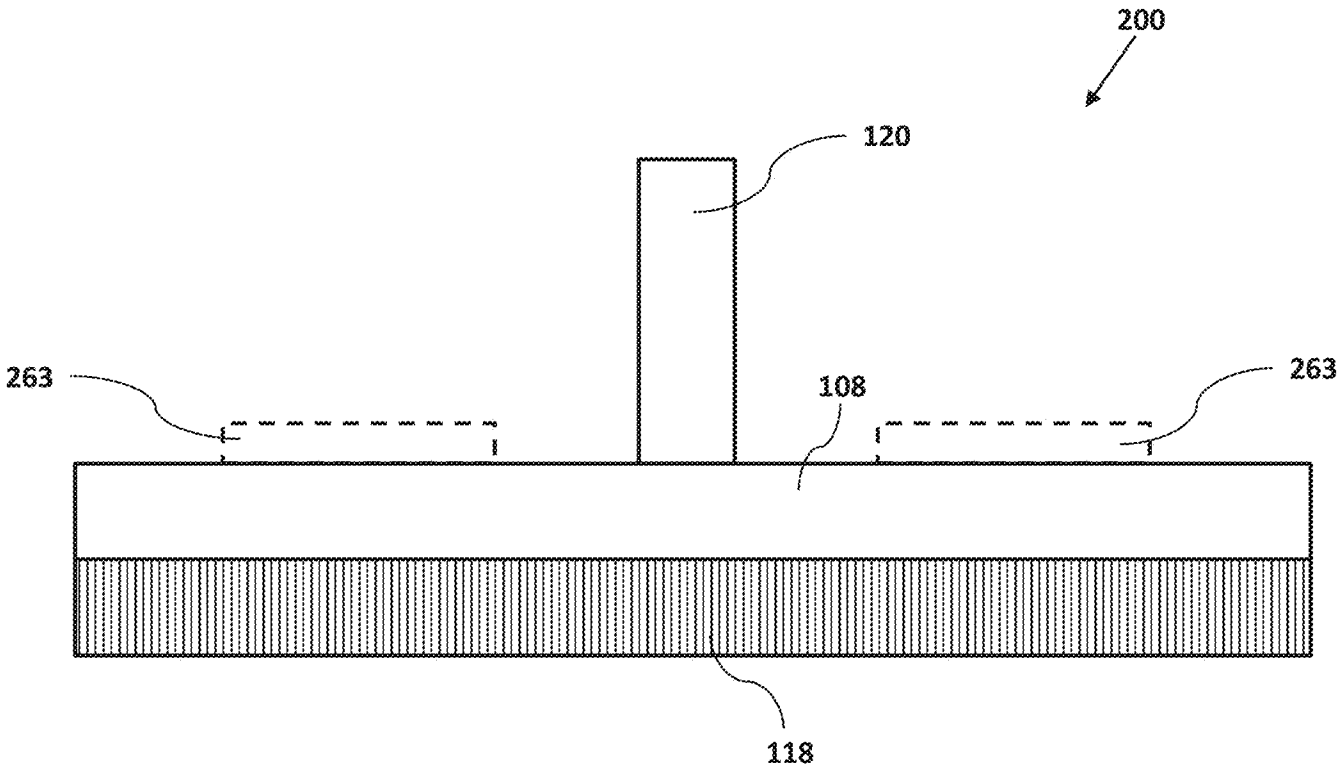
Figure 6E:
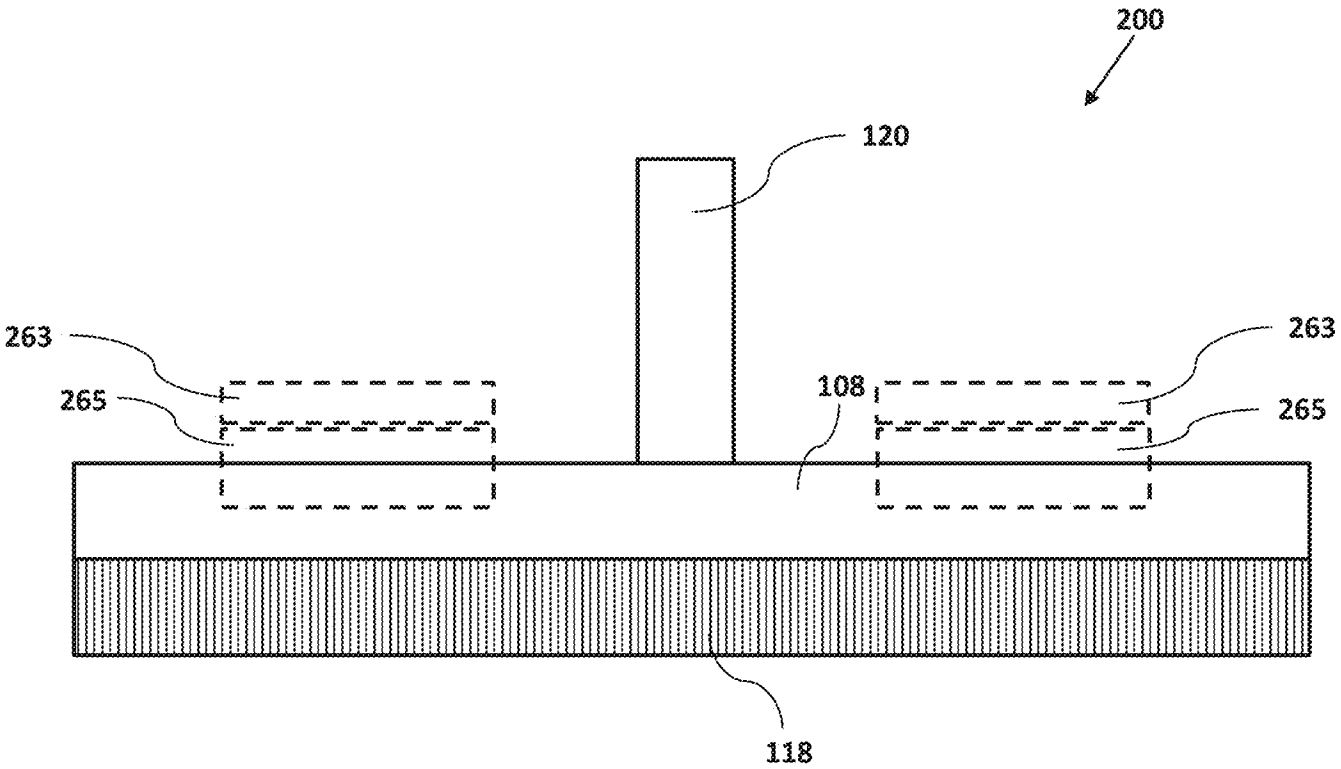

FIG. 6D illustrates another variation of the cleaning tool 200 that attaches the movable pressure members 263 directly to the support base 108, but that positions the movable pressure members 263 inward from the ends of the support base 108. Specifically, in this embodiment, the movable pressure members 263 are desirably positioned roughly centered between the tubular body 120 and the ends of the support base 108. Other positionings and/or lengths of the movable pressure members 263 may be used, however. Finally, FIG. 6E illustrates another variation of the cleaning tool 200. In this version, the cleaning tool 200 is similar in configuration to the version shown in FIG. 6D, except that the movable pressure members 263 are movably coupled to main bodies 265 that are in turn coupled to the support base 108 (similar to the configuration of FIGS. 2A and 6A, but with the bodies 265 moved inward toward the tubular body 120).

Additional Embodiments, Benefits, and Information

Some embodiments of cleaning tools disclosed herein may comprise different or additional features than those described above. For example, various types of locking mechanisms 373 be utilized. For example, a locking mechanism may be utilized that is essentially the opposite of the locking mechanism 373 shown in the drawings, meaning the distal end of the elongate curved member 431 may comprise a recess instead of a protruding member, and the main body 265 may comprise a plurality of mating protruding members instead of a plurality of mating recesses 534. As another example, a ball detent mechanism may be used. For example, one of the elongate curved member 431 or the recessed area 532 of the main body 265 may comprise one or more spring-loaded balls, and the other of the elongate curved member 431 or the recessed area 532 may comprise a plurality of depressions, grooves, recessed areas, and/or the like configured to mate with the one or more spring-loaded balls to retain the movable pressure member 263 in position with respect to the main body 265.

As another example, the movable pressure member 263 may not even include an elongate curved member 431, and locking or retention features may be built into the pivoting mechanism 271. For example, instead of just using concave hinge surfaces 504, the main body 265 may comprise a circular or substantially circular surface that can selectively clamp around the hinge pin 401 to maintain the relative orientation of the movable pressure member 263 with respect to the main body 265.

Further, although the drawings included herewith illustrate a pivot mechanism 371 at a forward or exterior side of the corner brush 247, and a locking mechanism 373 at a rearward or internal side of the corner brush 247, the positioning of the pivot mechanism 371 and locking mechanism 373 may be reversed, the pivot mechanism 371 and/or the locking mechanism 373 may be more centrally located, and/or the like.

In some embodiments, a pin lock mechanism is used for the locking mechanism 373. For example, one or more pins, which may or may not be spring loaded, may be configured to be slidable into or out of engagement with a corresponding hole, ledge, depression, and/or the like in the main body 265 or the movable pressure member 263.

In some embodiments, the movable pressure member 263 is pivotally coupled to the main body 265 using a friction lock hinge. For example, a hinge may be utilized that can be selectively locked and unlocked by turning a nut, threaded handle, and/or the like that causes a tension or compression load within a hinge pin that clamps the two components together and locks the hinge. In some embodiments, a clutch arrangement may be used in such a friction lock hinge. Alternatively, in some embodiments, the system may be designed such that there is sufficient friction in the pivot joint between the movable pressure member 263 and main body 265 that the water pressure on the system as the cleaning tool is passed through the water will not move the movable pressure member 263, but the movable pressure member 263 can still be moved manually by overcoming the friction force.

Further, as mentioned above, although the version shown in FIGS. 2A-5J incorporates a movable pressure member 263 into a removable corner brush 247, the concepts disclosed herein related to a movable pressure member 263 may be incorporated into alternative embodiments of cleaning tools that, for example, attach the movable pressure member 263 directly to a portion of the elongate support base 108, attach the movable pressure member 263 to a main body that is attached to the elongate support base 108 but that is not part of a corner brush, and/or the like (see, for example, the discussion above associated with FIGS. 6B-6E). For example, the same or similar structures that form pivot mechanism 371 and locking mechanism 373 may be incorporated directly into the support base 108, into a separate body that is not intended to be removable, and/or the like. In some embodiments, the external appearance of the cleaning tool may be the same or similar as shown in FIGS. 2A-2C, but the main body 265 may not be intended to be removable and/or the structures formed by the main body 265 may be integrated into the support base 108.

Additionally, although most of the drawings included herewith and the description above are associated with embodiments that have two movable pressure members 263 (one at either end of the elongate support base 108), the disclosure herein is not limited to that configuration, and various embodiments may utilize one, two, three, four, five, six, or more movable pressure members. The one or more movable pressure members may be coupled to the elongate support base 108 at various locations that are not limited to merely the ends of the elongate support base 108, the one or more movable pressure members may be coupled to the reinforcement member 106, and/or the like. In some embodiments, one or more movable pressure members are positioned along a majority of the upper surface 110 of the elongate support base 108 (see, for example, FIG. 6C). For example, one or more movable pressure members may be positioned along at least 50%, 60%, 70%, or 80% of the upper surface 110 of the elongate support base 108.

In some embodiments, a width of each of the movable pressure members 263 (e.g., width W shown in FIG. 4G) is approximately 20% of an overall width of the elongate support base 108 (e.g., a width measured along upper surface 110 of the elongate support base from one end to another. In some embodiments, the width W of each of the movable pressure members 263 is approximately, at least, or no more than 5%, 10%, 50%, 20%, 25%, 30%, 35%, 40%, 45%, or 50% of the width of the elongate support base 108. In some embodiments, the width W of each of the movable pressure members 263 is within a range of 10% to 30%, 15% to 25%, or 5% to 35% of the width of the elongate support base 108.

In some embodiments, instead of having a movable pressure member 263, a plurality of removable corner brushes are provided, with each of the removable corner brushes having an upper surface oriented at a different angle (e.g., equivalent to moving the movable pressure member 263, but replacing the corner brush instead of moving the pressure member 263).

Conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment. The headings used herein are for the convenience of the reader only and are not meant to limit the scope of the inventions or claims.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. Additionally, the skilled artisan will recognize that any of the above-described methods can be carried out using any appropriate apparatus. Further, the disclosure herein of any particular feature, aspect, method, property, characteristic, quality, attribute, element, or the like in connection with an embodiment can be used in all other embodiments set forth herein. For all of the embodiments described herein the steps of the methods need not be performed sequentially. Thus, it is intended that the scope of the present inventions herein disclosed should not be limited by the particular disclosed embodiments described above.

What is claimed is:

1. A pool cleaning tool comprising:

a brush head comprising an elongate frame and bristles extending therefrom, the elongate frame extending from a first end to a second end, and the elongate frame having an upper surface and a lower surface, the bristles extending from the lower surface;

a first corner brush removably attached to the first end of the elongate frame; and a second corner brush removably attached to the second end of the elongate frame, wherein each of the first corner brush and the second corner brush comprises:

a body removably attached to the elongate frame, the body having additional bristles extending therefrom;

a rotatable pressure member that comprises:

an upper surface positioned above the upper surface of the elongate frame; and a forward end pivotally coupled to the body such that the rotatable pressure member can pivot with respect to the body about a pivot axis; and a locking mechanism comprising one or more mating protrusions and recesses configured to selectively retain the rotatable pressure member in each of a plurality of positions with respect to the body, wherein each of the plurality of positions of the rotatable pressure member with respect to the body corresponds to a different orientation of the upper surface of the rotatable pressure member with respect to the body.

2. The pool cleaning tool of claim 1, wherein the locking mechanism comprises a protrusion of the rotatable pressure member that is configured to selectively mate with each of a plurality of recesses in the body.

3. The pool cleaning tool of claim 2, wherein the plurality of recesses in the body are aligned along an arc shaped path.

4. The pool cleaning tool of claim 3, wherein the arc shaped path comprises a center of rotation that is aligned with the pivot axis.

5. The pool cleaning tool of claim 1, wherein the upper surface of the rotatable pressure member comprises an s-shaped profile.

6. The pool cleaning tool of claim 1, wherein the upper surface of the rotatable pressure member is angled inward toward a center of the brush head.

7. A pool cleaning tool comprising:

a brush head comprising an elongate frame and bristles extending therefrom, the elongate frame extending from a first end to a second end, and the elongate frame having an upper surface and a lower surface, the bristles extending from the lower surface;

a first adjustable pressure mechanism attached to the first end of the elongate frame; and a second adjustable pressure mechanism attached to the second end of the elongate frame, wherein each of the first adjustable pressure mechanism and the second adjustable pressure mechanism comprises:

a rotatable pressure member that comprises:

a forward end pivotally coupled to the elongate frame about a rotation axis; and an upper surface configured to be rotatable about the rotation axis, the upper surface of the rotatable pressure member configured to force the bristles against a surface being cleaned as a result of the brush head being pushed through water in a direction perpendicular to a direction at which the bristles extend; and a locking mechanism configured to selectively retain the upper surface of the rotatable pressure member in each of a plurality of positions with respect to elongate frame, wherein each of the plurality of positions corresponds to a different orientation of the upper surface of the rotatable pressure member with respect to the elongate frame.

8. The pool cleaning tool of claim 7, wherein the rotatable pressure member of each of the first and second adjustable pressure mechanisms is attached directly to the elongate frame.

9. The pool cleaning tool of claim 7, wherein the rotatable pressure member of each of the first and second adjustable pressure mechanisms is attached to the elongate frame through a separate body that is attached to the elongate frame.

10. The pool cleaning tool of claim 9, wherein the separate body is part of a removable corner brush.

11. The pool cleaning tool of claim 7, wherein the upper surface of each rotatable pressure member comprises an s-shaped profile.

12. The pool cleaning tool of claim 7, wherein the locking mechanism comprises at least one protrusion configured to selectively engage each of a plurality of mating recesses.

13. A removable corner brush for a pool cleaning tool, the removable corner brush comprising:

a body extending along a longitudinal direction from a first end to a second end;

a plurality of bristles extending from the second end of the body;

a U-shaped track for receiving an elongate member of a pool cleaning tool, the U-shaped track extending within the body along the longitudinal direction; and a rotatable pressure member, the rotatable pressure member comprising:

a forward end pivotally coupled to the body such that the rotatable pressure member can pivot with respect to the body about a pivot axis;

a locking mechanism configured to selectively retain the rotatable pressure member in each of a plurality of positions with respect to the body; and an upper surface extending at an angle to the longitudinal direction, wherein each of the plurality of positions of the rotatable pressure member with respect to the body corresponds to a different orientation about the pivot axis of the upper surface with respect to the body.

14. The removable corner brush of claim 13, wherein the pivot axis extends along the longitudinal direction.

15. The removable corner brush of claim 13, wherein the locking mechanism comprises at least one protrusion configured to selectively engage each of a plurality of mating recesses.

16. The removable corner brush of claim 15, wherein the at least one protrusion is located at a distal end of an elongate curved member of the rotatable pressure member, and wherein the plurality of mating recesses are part of the body.

17. The removable corner brush of claim 16, wherein the plurality of mating recesses are aligned along an arc shaped path.

18. The removable corner brush of claim 17, wherein the arc shaped path comprises a center of rotation that is aligned with the pivot axis.

19. The removable corner brush of claim 13, wherein the upper surface comprises an s-shaped profile.

20. The removable corner brush of claim 13, wherein the upper surface comprises a curved profile.

* * * * *